US010706674B2

(12) United States Patent
Sorey et al.

(10) Patent No.: US 10,706,674 B2
(45) Date of Patent: Jul. 7, 2020

(54) ELECTRONIC GAMING MACHINES AND RELATED METHODS WITH PLAYER EMOTIONAL STATE PREDICTION

(71) Applicant: IGT, Las Vegas, NV (US)

(72) Inventors: Tyler Sorey, Reno, NV (US); Dwayne Nelson, Las Vegas, NV (US); Cameron Rowe, Reno, NV (US); Steven LeMay, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 15/979,717

(22) Filed: May 15, 2018

(65) Prior Publication Data

US 2019/0355209 A1 Nov. 21, 2019

(51) Int. Cl.

| | |
|---|---|
| ***A63F 9/00*** | (2006.01) |
| ***G07F 17/32*** | (2006.01) |
| ***G07F 17/34*** | (2006.01) |

(52) U.S. Cl.

CPC ..... *G07F 17/3239* (2013.01); *G07F 17/3206* (2013.01); *G07F 17/3213* (2013.01); *G07F 17/34* (2013.01)

(58) Field of Classification Search

None

See application file for complete search history.

(56) References Cited

U.S. PATENT DOCUMENTS

| | | | | |
|---|---|---|---|---|
| 8,863,619 | B2 * | 10/2014 | Frank | G06F 3/013 76/12 |
| 9,015,084 | B2 * | 4/2015 | Thieberger | G06Q 10/063 706/12 |
| 10,134,226 | B2 * | 11/2018 | Keilwert | G07F 17/3227 |
| 2009/0270170 | A1 * | 10/2009 | Patton | A63F 13/10 463/36 |
| 2009/0325693 | A1 * | 12/2009 | Ron | B24B 9/144 463/30 |
| 2011/0009193 | A1 * | 1/2011 | Bond | A63F 13/42 463/36 |
| 2012/0021814 | A1 * | 1/2012 | Gurovich | G07F 17/3206 463/16 |
| 2015/0126268 | A1 * | 5/2015 | Keilwert | G07F 17/3227 463/23 |
| 2016/0144278 | A1 * | 5/2016 | el Kaliouby | A61B 5/165 463/36 |
| 2018/0053194 | A1 * | 2/2018 | Bond | G06Q 30/02 |

* cited by examiner

*Primary Examiner* — Seng H Lim

(74) *Attorney, Agent, or Firm* — Sage Patent Group

(57) ABSTRACT

A method of operating an electronic gaming machine includes providing a predictive model of an emotional state of a player of the electronic gaming machine, obtaining biometric data associated with the player, and analyzing the biometric data to detect an emotional state of the player. The method detects occurrence of a game play event of the electronic device, generates a predicted emotional state of the player as a result of the occurrence of the game play event, and modifies an aspect of a game play experience of the electronic gaming machine based on the predicted emotional state of the player in response to the game play event.

20 Claims, 14 Drawing Sheets

ELECTRONIC GAMING MACHINES AND RELATED METHODS WITH PLAYER EMOTIONAL STATE PREDICTION

BACKGROUND

Electronic and electro-mechanical gaming machines (EGMs) are systems that allow users to place a wager on the outcome of a random event, such as the spinning of mechanical or virtual reels or wheels, the playing of virtual cards, the rolling of mechanical or virtual dice, the random placement of tiles on a screen, etc.

Systems for detecting the emotional state of a player of an EGM have been described. For example, U.S. Pat. No. 8,460,090, assigned to the assignee of the present application, discloses gaming devices and methods that provide an estimated emotional state of a player based on the occurrence of one or more designated events.

SUMMARY

This summary is provided to introduce simplified concepts of a transparent display active backlight that are further described below in the Detailed Description. This summary is not intended to identify essential features of the claimed subject matter, nor is it intended for use in determining the scope of the claimed subject matter.

A method according to some embodiments includes providing a predictive model of an emotional state of a player of an electronic gaming machine, wherein the predictive model includes a plurality of input parameters associated with operation of the electronic gaming machine by the player, obtaining, via a biometric data input device, biometric data associated with the player while the player is engaged in using the electronic gaming machine, analyzing the biometric data to detect an emotional state of the player while the player is engaged in using the electronic gaming machine, providing the detected emotional state of the player as an input parameter to the predictive model, detecting occurrence of a game play event of the electronic device, wherein the game play event is associated with one of the input parameters of the predictive model, generating, via the predictive model, a predicted emotional state of the player as a result of the occurrence of the game play event, and modifying an aspect of a game play experience of the electronic gaming machine based on the predicted emotional state of the player.

A method according to further embodiments includes providing a predictive model of an emotional state of a player of an electronic gaming machine, wherein the predictive model includes a plurality of input parameters associated with operation of the electronic gaming machine, obtaining, via a biometric data input device, biometric data associated with the player while the player is engaged in using the electronic gaming machine, analyzing the biometric data to detect an emotional state of the player while the player is engaged in using the electronic gaming machine, generating, via the predictive model, a predicted emotional state of the player as a result of a modification of an aspect of a game play experience of the electronic gaming machine, wherein the aspect of the game play experience is associated with one of the input parameters of the predictive model, modifying the aspect of a game play experience of the electronic gaming machine, obtaining additional biometric data associated with the player after modification of the aspect of the game play experience, analyzing the additional biometric data to detect an actual emotional state of the player after modification of the aspect of the game play experience, comparing the actual emotional state of the player after modification of the aspect of the game play experience with the predicted emotional state of the player after modification of the aspect of the game play experience, and modifying the predictive model based on comparison of the actual emotional state of the player after modification of the aspect of the game play experience with the predicted emotional state of the player as a result of modification of the aspect of the game play experience.

An electronic gaming machine according to some embodiments includes a processor, and a biometric input device coupled to the processor and configured to obtain biometric data associated with a player while the player is engaged in using the electronic gaming machine. The processor is configured to perform operations including providing a predictive model of an emotional state of a player of an electronic gaming machine, wherein the predictive model includes a plurality of input parameters associated with operation of the electronic gaming machine by the player, analyzing the biometric data to detect an emotional state of the player while the player is engaged in using the electronic gaming machine, providing the detected emotional state of the player as an input parameter to the predictive model, detecting occurrence of a game play event of the electronic device, wherein the game play event is associated with one of the input parameters of the predictive model, generating, via the predictive model, a predicted emotional state of the player as a result of the occurrence of the game play event, and modifying an aspect of a game play experience of the electronic gaming machine based on the predicted emotional state of the player.

DETAILED DESCRIPTION

Figure 1A:
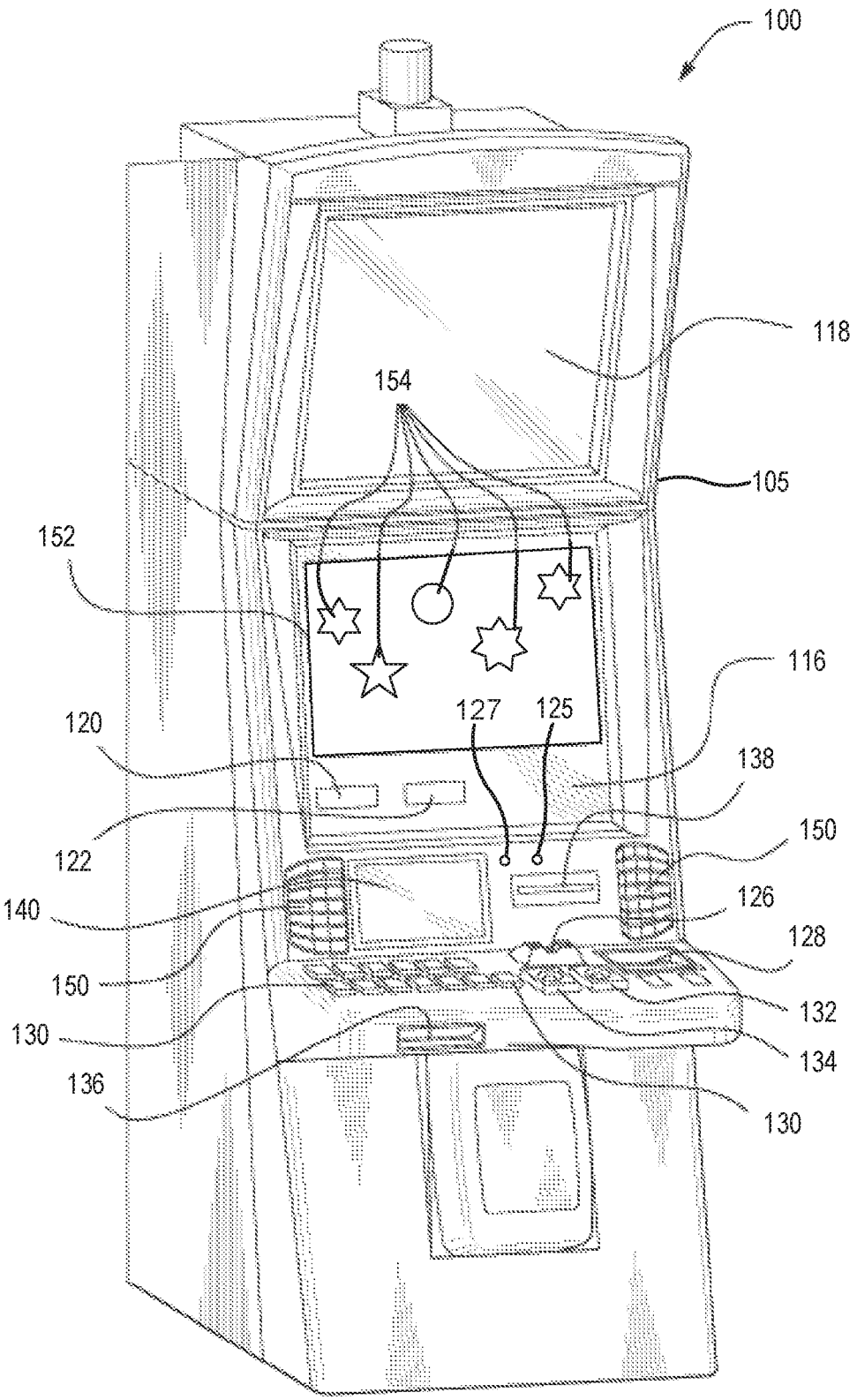
FIG. 1A is a perspective view of an electronic gaming device that can be configured according to some embodiments.

Embodiments of the inventive concepts provide electronic gaming machines (EGMs) that detect a player's emotional state, or mood, while they are engaged in playing a game on the EGM. Some embodiments use a predictive model to predict a player's emotional response to a game event, and modify the game event based on the predicted emotional response. In this manner, the EGM may precompensate for an anticipated emotional response of the player.

Emotional state, or mood, detection may be performed by an EGM in real-time. Mood detection may be performed based on biofeedback, such as image data provided by a player-facing camera on the EGM. Some embodiments employ one or more adaptive neural network models that provide the ability to learn about a specific player's emotional responses over time. These embodiments may tailor the gaming experience to the individual player. Although neural networks do not require special hardware they do require input from the player, such as input relating to the player's mood that can be detected from biometric data.

Some embodiments provide various techniques for changing EGM behavior to more effectively entertain and retain players based on their individual characteristics. As a player engages with an EGM via normal gameplay (winning and losing) or bonus play they will have some emotional response. This emotional response can be characterized through mood detection to gage how enjoyable the EGM interaction is for the player.

Based on normal gameplay systems/methods according to some embodiments can determine how a player is feeling at any given moment. With that information systems/methods according to some embodiments can estimate the likelihood of that player leaving the machine due to an unpleasant experience in one form or another (depression, sadness, anger, etc.) In the event that the EGM determines the player's mood is such that the player will likely quit the game, systems/methods according to some embodiments can make an adjustment in gameplay to improve the player's experience. This can be accomplished through a variety of mechanisms.

For example, based on the adaptive system's growing knowledge of a player and their preferences, systems/methods according to some embodiments can determine an optimal (in terms of mood) gameplay experience for the player. For example, systems/methods according to some embodiments can, over time, determine that a player generally has a higher average mood rating when winning frequent smaller prizes or larger infrequent prizes and can adjust the paytable to conform to the player's enjoyment.

Similar to the win/loss adjustment, systems/methods according to some embodiments can also determine the impact of bonuses on player mood. Over time, the EGM can learn how an individual player's mood is impacted by bonuses as well as how long they are willing to stay seated without hitting one. For example, if over time the EGM learns that a player's mood degrades to the point of leaving after 15 games with no bonus, the systems/methods can adjust the game's bonuses to make sure they get one within that time. Or if the situation arises where the EGM determines that bonuses are happening too often, the systems/methods can also adjust back to provide an optimal amount of bonus games. It will be appreciated that, at both ends of this spectrum (increasing or decreasing bonus frequency), upper and lower bounds may be provided to ensure the bonus games are not offered too often or too infrequently.

Other adjustments are also possible to improve player mood, such as symbol changes, color scheme changes, audio tracks, rate of play. All of these factors can be learned about a player and adjusted over time to ensure an optimal gaming experience. In this way, the EGM can cater to players that like larger, less frequent bonuses but a faster rate of play as well as the players that like a slow gameplay pace but frequent, small bonuses.

As the EGM learns the player, the systems/methods described herein can fine tune the gaming experience to the player's liking, and may also adjust the game to a player's change in preference. Since this system is constantly learning about a player, if their preferences begin to shift, the systems/methods disclosed herein can keep up with that to ensure a good experience.

It is inevitable that during a player's gaming experience they will lose a game. Systems/methods described herein attempt to mitigate the impact of a loss on a player's overall experience. In the event of a loss, the systems/methods described herein can learn how a player reacts to different behavior to ensure the loss does not upset the player too much. For example, it is possible that losing would upset the player, but by seeing an animated increase in a progressive win amount(s) a player's mood is less impacted by the loss.

Electronic Gaming Machines

Figure 1B:
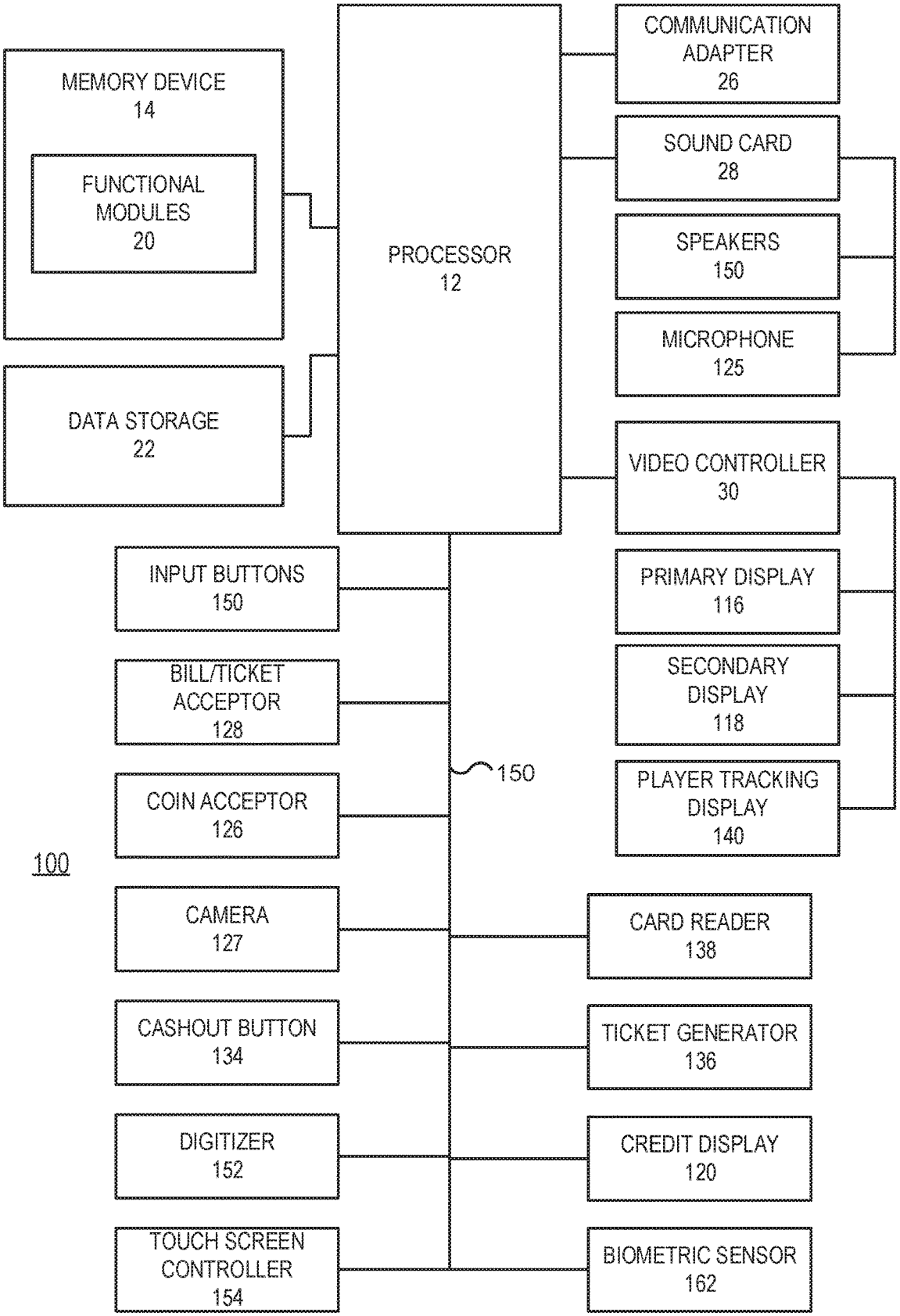
FIG. 1B is a schematic block diagram illustrating an electronic configuration for a gaming device according to some embodiments.
Figure 1C:
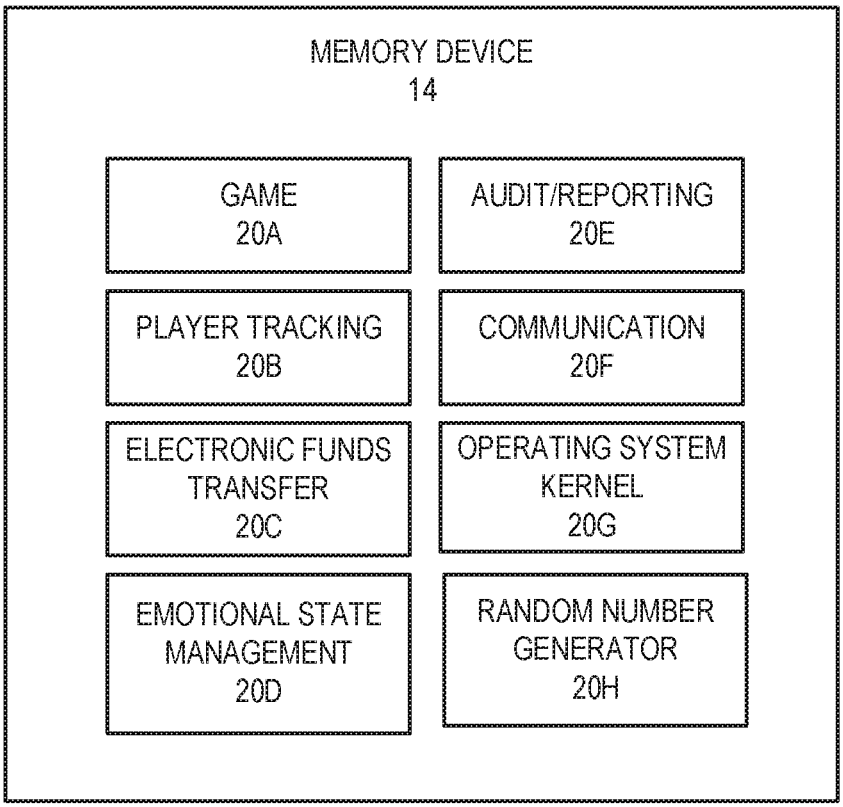
FIGS. 1C and 1D are block diagrams that illustrates various functional modules of an electronic gaming device according to some embodiments.
Figure 1D:
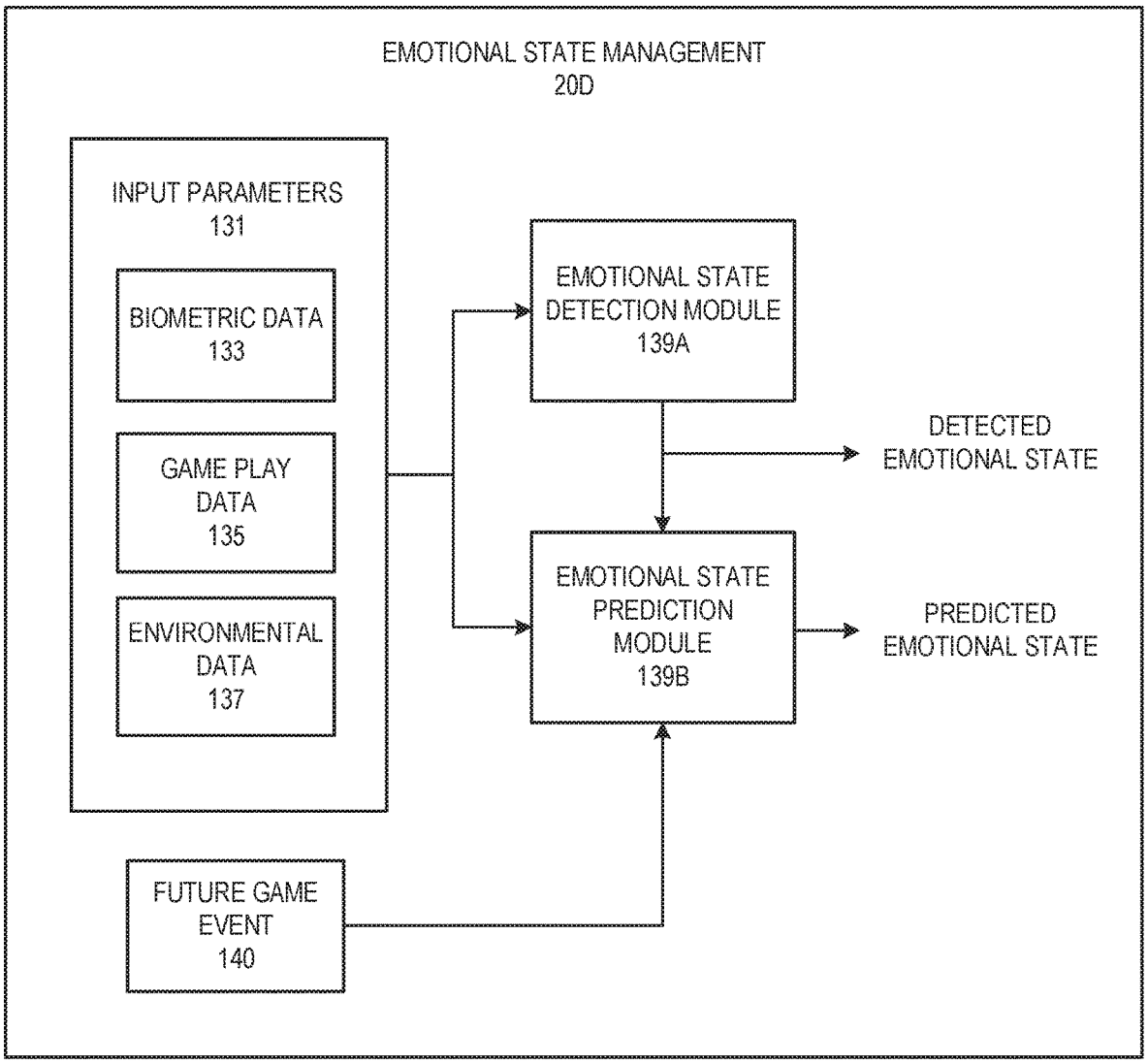

An example of an electronic gaming machine (EGM) that can host hybrid games according to various embodiments is illustrated in FIGS. 1A, 1B, 1C, and 1D in which FIG. 1A is a perspective view of an EGM 100 illustrating various physical features of the device, FIG. 1B is a functional block diagram that schematically illustrates an electronic relationship of various elements of the EGM 100, and FIGS. 1C and 1D illustrate various functional modules that can be stored in a memory device of the EGM 100. The embodiments shown in FIGS. 1A to 1D are provided as examples for illustrative purposes only. It will be appreciated that EGMs may come in many different shapes, sizes, layouts, form factors, and configurations, and with varying numbers and types of input and output devices, and that embodiments of the inventive concepts are not limited to the particular EGM structures described herein.

EGMs typically include a number of standard features, many of which are illustrated in FIGS. 1A and 1B. For example, referring to FIG. 1A, an EGM 100 may include a support structure, housing or cabinet 105 which provides support for a plurality of displays, inputs, outputs, controls and other features that enable a player to interact with the EGM 100.

The EGM 100 illustrated in FIG. 1A includes a number of display devices, including a primary display device 116 located in a central portion of the cabinet 105 and a secondary display device 118 located in an upper portion of the cabinet 105. It will be appreciated that one or more of the display devices 116, 118 may be omitted, or that the display devices 116, 118 may be combined into a single display device. The EGM 100 may further include a player tracking display 140, and a credit display 120. The credit display 120 displays a player's current number of credits, cash, account balance or the equivalent. A bet display that displays a player's amount wagered may be provided separately and/or incorporated into another display.

The player tracking display 140 may be used to display a service window that allows the player to interact with, for example, their player loyalty account to obtain features, bonuses, comps, etc. In other embodiments, additional display screens may be provided beyond those illustrated in FIG. 1A.

The EGM 100 may further include a number of input devices that allow a player to provide various inputs to the EGM 100, either before, during or after a game has been played. For example, the EGM 100 may include a plurality of input buttons 130 that allow the player to select options before, during or after game play. The input buttons 130 may include a game play initiation button 132 and a cashout button 134. The cashout button 134 is utilized to receive a cash payment or any other suitable form of payment corresponding to a quantity of remaining credits of a credit display.

In some embodiments, one or more input devices of the EGM 100 are one or more game play activation devices that are each used to initiate a play of a game on the EGM 100 or a sequence of events associated with the EGM 100 following appropriate funding of the EGM 100. The example EGM 100 illustrated in FIGS. 1A and 1B includes a game play activation device in the form of a game play initiation button 132. It should be appreciated that, in other embodiments, the EGM 100 begins game play automatically upon appropriate funding rather than upon utilization of the game play activation device.

In some embodiments, one or more input devices of the EGM 100 are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In some embodiments, one or more of the display screens may include a touch-sensitive display that includes a digitizer 152 and a touchscreen controller 154 (FIG. 1B). The player may interact with the EGM 100 by touching virtual buttons on one or more of the display devices 116, 118, 140. Accordingly, any of the above described input devices, such as the input buttons 130, the game play initiation button 132 and/or the cashout button 134 may be provided as virtual buttons on one or more of the display devices 116, 118, 140.

Referring briefly to FIG. 1B, operation of the primary display device 116, the secondary display device 118 and the player tracking display 140 may be controlled by a video controller 30 that receives video data from a processor 12 or directly from a memory device 14 and displays the video data on the display screen. The credit display 120 is typically implemented as simple LCD or LED displays that display a number of credits available for wagering and a number of credits being wagered on a particular game. Accordingly, the credit display 120 may be driven directly by the processor 12. In some embodiments, however, the credit display 120 may be driven by the video controller 30.

Referring again to FIG. 1A, the display devices 116, 118, 140 may include, without limitation: a cathode ray tube, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display devices 116, 118, 140 may include a touchscreen with an associated touch-screen controller 154 and digitizer 152. The display devices 116, 118, 140 may be of any suitable size, shape, and/or configuration. The display devices 116, 118, 140, may include flat and/or curved display surfaces.

The display devices 116, 118, 140 and video controller 30 of the EGM 100 are generally configured to display one or more game and/or non-game images, symbols, and indicia. In certain embodiments, the display devices 116, 118, 140 of the EGM 100 are configured to display any suitable visual representation or exhibition of the movement of objects; dynamic lighting; video images; images of people, characters, places, things, and faces of cards; and the like. In certain embodiments, the display devices 116, 118, 140 of the EGM 100 are configured to display one or more virtual reels, one or more virtual wheels, and/or one or more virtual dice. In other embodiments, certain of the displayed images, symbols, and indicia are in mechanical form. That is, in these embodiments, the display device 116, 118, 140 includes any electromechanical device, such as one or more rotatable wheels, one or more reels, and/or one or more dice, configured to display at least one or a plurality of game or other suitable images, symbols, or indicia.

The EGM 100 also includes various features that enable a player to deposit credits in the EGM 100 and withdraw credits from the EGM 100, such as in the form of a payout of winnings, credits, etc. For example, the EGM 100 may include a ticket dispenser 136 that is configured to generate and provide a ticket or credit slip representing a payout and/or a credit balance. The ticket or credit slip is printed by the EGM 100 when the cashout button 134 is pressed, and typically includes a barcode or similar device that allows the ticket to be redeemed via a cashier, a kiosk, or other suitable redemption system, or to be deposited into another gaming machine. The EGM 100 may further include a bill/ticket acceptor 128 that allows a player to deposit credits in the EGM 100 in the form of paper money or a ticket/credit slip, and a coin acceptor 126 that allows the player to deposit coins into the EGM 100. Other means of depositing or crediting monetary value to the player, such as by electronic funds transfer, wireless payment, etc., may be provided.

While not illustrated in FIG. 1A, the EGM 100 may also include a note dispenser configured to dispense paper currency and/or a coin generator configured to dispense coins or tokens in a coin payout tray.

The EGM 100 may further include one or more speakers 150 controlled by one or more sound cards 28 (FIG. 1B). The EGM 100 illustrated in FIG. 1A includes a pair of speakers 150. In other embodiments, additional speakers, such as surround sound speakers, may be provided within or on the cabinet 105. Moreover, the EGM 100 may include built-in seating with integrated headrest speakers.

In various embodiments, the EGM 100 may generate dynamic sounds coupled with attractive multimedia images displayed on one or more of the display devices 116, 118, 140 to provide an audio-visual representation or to otherwise display full-motion video with sound to attract players to the EGM 100 and/or to engage the player during gameplay. In certain embodiments, the EGM 100 may display a sequence of audio and/or visual attraction messages during idle periods to attract potential players to the EGM 100. The videos may be customized to provide any appropriate information.

The EGM 100 may further include a card reader 138 that is configured to read magnetic stripe cards, such as player loyalty/tracking cards, chip cards, and the like. In some embodiments, a player may insert an identification card into a card reader of the gaming device. In some embodiments, the identification card is a smart card having a programmed microchip or a magnetic strip coded with a player's identification, credit totals (or related data) and other relevant information. In other embodiments, a player may carry a portable device, such as a cell phone, a radio frequency identification tag or any other suitable wireless device, which communicates a player's identification, credit totals (or related data) and other relevant information to the gaming device. In some embodiments, money may be transferred to a gaming device through electronic funds transfer. When a player funds the gaming device, the processor determines the amount of funds entered and displays the corresponding amount on the credit or other suitable display as described above.

In some embodiments, the EGM 100 may include an electronic payout device or module configured to fund an electronically recordable identification card or smart card or a bank or other account via an electronic funds transfer to or from the EGM 100.

FIG. 1B is a block diagram that illustrates logical and functional relationships between various components of an EGM 100. As shown in FIG. 1B, the EGM 100 may include a processor 12 that controls operations of the EGM 100. Although illustrated as a single processor, multiple special purpose and/or general purpose processors and/or processor cores may be provided in the EGM 100. For example, the EGM 100 may include one or more of a video processor, a signal processor, a sound processor and/or a communication controller that performs one or more control functions within the EGM 100. The processor 12 may be variously referred to as a "controller," "microcontroller," "microprocessor" or simply a "computer." The processor may further include one or more application-specific integrated circuits (ASICs).

Various components of the EGM 100 are illustrated in FIG. 1B as being connected to the processor 12. It will be appreciated that the components may be connected to the processor 12 through a system bus 115, a communication bus and controller, such as a USB controller and USB bus, a network interface, or any other suitable type of connection.

The EGM 100 further includes a memory device 14 that stores one or more functional modules 20.

The memory device 14 may store program code and instructions, executable by the processor 12, to control the EGM 100. The memory device 14 may also store other data such as image data, event data, player input data, random or pseudo-random number generators, paytable data or information and applicable game rules that relate to the play of the gaming device. The memory device 14 may include random access memory (RAM), which can include nonvolatile RAM (NVRAM), magnetic RAM (MRAM), ferroelectric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The EGM 100 may further include a data storage device 22, such as a hard disk drive or flash memory. The data storage device 22 may store program data, player data, audit trail data or any other type of data. The data storage device 22 may include a detachable or removable memory device, including, but not limited to, a suitable cartridge, disk, CD ROM, DVD or USB memory device.

The EGM 100 may include a communication adapter 26 that enables the EGM 100 to communicate with remote devices over a wired and/or wireless communication network, such as a local area network (LAN), wide area network (WAN), cellular communication network, or other data communication network. The communication adapter 26 may further include circuitry for supporting short range wireless communication protocols, such as Bluetooth and/or near field communications (NFC) that enable the EGM 100 to communicate, for example, with a mobile communication device operated by a player.

The EGM 100 may include one or more internal or external communication ports that enable the processor 12 to communicate with and to operate with internal or external peripheral devices, such as eye tracking devices, position tracking devices, cameras, accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumb drives, ticket readers, touchscreens, trackballs, touchpads, wheels, and wireless communication devices. In some embodiments, internal or external peripheral devices may communicate with the processor through a universal serial bus (USB) hub (not shown) connected to the processor 12. U.S. Patent Application Publication No. 2004/0254014 describes a variety of EGMs including one or more communication ports that enable the EGMs to communicate and operate with one or more external peripherals.

In some embodiments, the EGM 100 may include a sensor, such as a camera 127 in communication with the processor 12 (and possibly controlled by the processor 12) that is selectively positioned to acquire an image of a player actively using the EGM 100 and/or the surrounding area of the EGM 100. In one embodiment, the camera may be configured to selectively acquire still or moving (e.g., video) images and may be configured to acquire the images in either an analog, digital or other suitable format. The display devices 116, 118, 140 may be configured to display the image acquired by the camera as well as display the visible manifestation of the game in split screen or picture-in-picture fashion. For example, the camera may acquire an image of the player and the processor 12 may incorporate that image into the primary and/or secondary game as a game image, symbol or indicia.

The EGM 100 may further include a microphone 125 connected to the sound card 28 and arranged to pick up sounds generated by the player.

Still referring to FIGS. 1A and 1B, the EGM 100 may include one or more biometric sensors 162 that can be used to help gauge an emotional state of the player. The biometric sensor 162 may include, for example, a pulse monitor, a respiratory monitor, a blood oxygen level monitor, a body temperature monitor, a stress monitor, etc., that is mounted, for example, on a handle or joystick 164 attached to the EGM 100. The biometric sensor 162 may include one or more electrodes that, when contacted by the player, allow the biometric sensor 162 to measure one or more physiological conditions of the player that may indicate stress, such as increased body or skin temperature, increased pulse rate, increased respiratory rate, stress-related electrical conductance fluctuations in the player's skin, changes in blood oxygen level, etc. The EGM 100 may further include strain gauges in the mechanical input devices, such as buttons, to detect how hard the player is pressing the buttons.

In some embodiments, the output of the biometric sensor 162 may be provided to the processor 12, which may generate one or more metrics, referred to herein as a "emotional state metrics," that indicate an emotional state of the player. As discussed in more detail below, the emotional state metrics may indicate the emotional state of the player in one dimension or more than one dimension.

In addition to the output of the biometric sensor 162, the emotional state metrics may take into account data collected from the microphone 125 and/or the camera 127. In some embodiments, the camera 127 maybe configured to capture infrared images of the player that can be used to detect changes in skin or body temperature of the player. In some embodiments, images captured by the camera 127 and/or sounds captured by the microphone 125 can be analyzed to identify changes in the respiratory rate of the player. In some embodiments, the player's voice can be monitored using the microphone 125 to detect changes in voice pitch that may indicate an increased level of stress. Similarly, the player's movements can be tracked and analyzed to detect changes, such as increased frequency or speed of movements, that may indicate that the player is experiencing an increased level of stress. The emotional state metrics may also take into account the player's performance at the game. For example, the emotional state metrics may take into account a player's overall monetary gains or losses, the player's total number of wins and losses, a number of losses in a row (i.e., the length of a current losing streak), or other factors. The emotional state metrics will be discussed in more detail below.

The EGM 100 may further include an actuator controller 180. The actuator controller 180, which is controlled by the processor 12, controls one or more actuators that can operate one or more stress relieving features of the EGM 100, as discussed in more detail below.

It will be appreciated that various components illustrated in FIG. 1B may be provided within a single device or within multiple devices. For example, the human input devices illustrated in FIG. 1B (e.g., the displays, input buttons, microphone, speaker, camera, etc., may be provided within a local device and other components, such as the processor, data storage and memory, may be provided in a separate device, such as a remote computing device that communicates with the handheld device over a data communication network or connection including one or more wireless communication links. The local device may, for example, include a handheld device, a desktop device, a tablet computer, etc. In this regard, the local device and/or the remote computing device, alone or together, may be considered to constitute an electronic gaming machine.

Various functional modules of that may be stored in a memory device 14 of an EGM 100 are illustrated in FIG. 1C. Program code contained in the functional modules controls the processor 12 to perform the functions described herein. Referring to FIG. 1C, the EGM 100 may include in the memory device 14 a primary game module 20A that includes program instructions and/or data for operating a wagering game as described herein. The EGM 100 may further include a player tracking module 20B that keeps track of the identity and other information related to the current player, an electronic funds transfer module 20C that manages transfer of credits to/from the player's account, an emotional state management module 20D that generates and processes the emotional state metrics described herein, an audit/reporting module 20E that generates audit reports of games played on the EGM 100, a communication module 20F that manages network and local communications of the EGM 100, an operating system 20G and a random number generator 20H. The electronic funds transfer module 20C communicates with a back end server or financial institution to transfer funds to and from an account associated with the player. The communication module 20F enables the EGM 100 to communicate with remote servers and other EGMs using various secure communication interfaces. The operating system kernel 20G controls the overall operation of the EGM 100, including the loading and operation of other modules. The random number generator 20H generates random or pseudorandom numbers for use in the operation of the hybrid games described herein.

Referring to FIG. 1D, the emotional state management module 20D may include an emotional state detection module 139A and an emotional state prediction module 139B. Each of these modules may utilize an artificial neural network to detect a player's emotional state or to predict a change in a player's emotional state based on an event, such as an in-game event, an out-of-game event, or a change in the player's game play experience. That is, each of the emotional state detection module 139A and the emotional state prediction module 139B may have an associated number of input parameters 131 corresponding to various aspects of a user's current state and one or more output parameters corresponding to the player's current emotional state (in the case of the emotional state detection module 139A) or predicted emotional state (in the case of the emotional state prediction module 139B).

As an example, the emotional state detection module 139A may have a number of input parameters 131 corresponding to biometric data 133 collected from the player, game play data 134 relating to a current gaming session, environmental data 137 relating to the environmental conditions experienced by the player (e.g., ambient noise level, ambient light levels, etc.). These input parameters are provided to an artificial neural network that processes the input parameters using a plurality of hidden nodes having corresponding weights and activation functions as described in more detail below, and responsively generates one or more output parameters that correspond to a player's emotional state. The emotional state prediction module 139B may have similar input parameters and output parameters as the emotional state detection module 139A, except that the emotional state prediction module 139B may have one additional input corresponding to the current emotional state of the player output by the emotional state detection module 139A and one additional input corresponding to a future game event 140, and the output parameters of the emotional state prediction module 139B may correspond to a predicted emotional state of the player in response to the future game event given the current emotional state of the player and the other input parameters. Thus, the emotional state detection module 139A may be used by the EGM 100 to detect a current emotional state of a player, while the emotional state prediction module 139B may be used to predict a future emotional state of the player based on a future game event.

EGM Network

Figure 2:
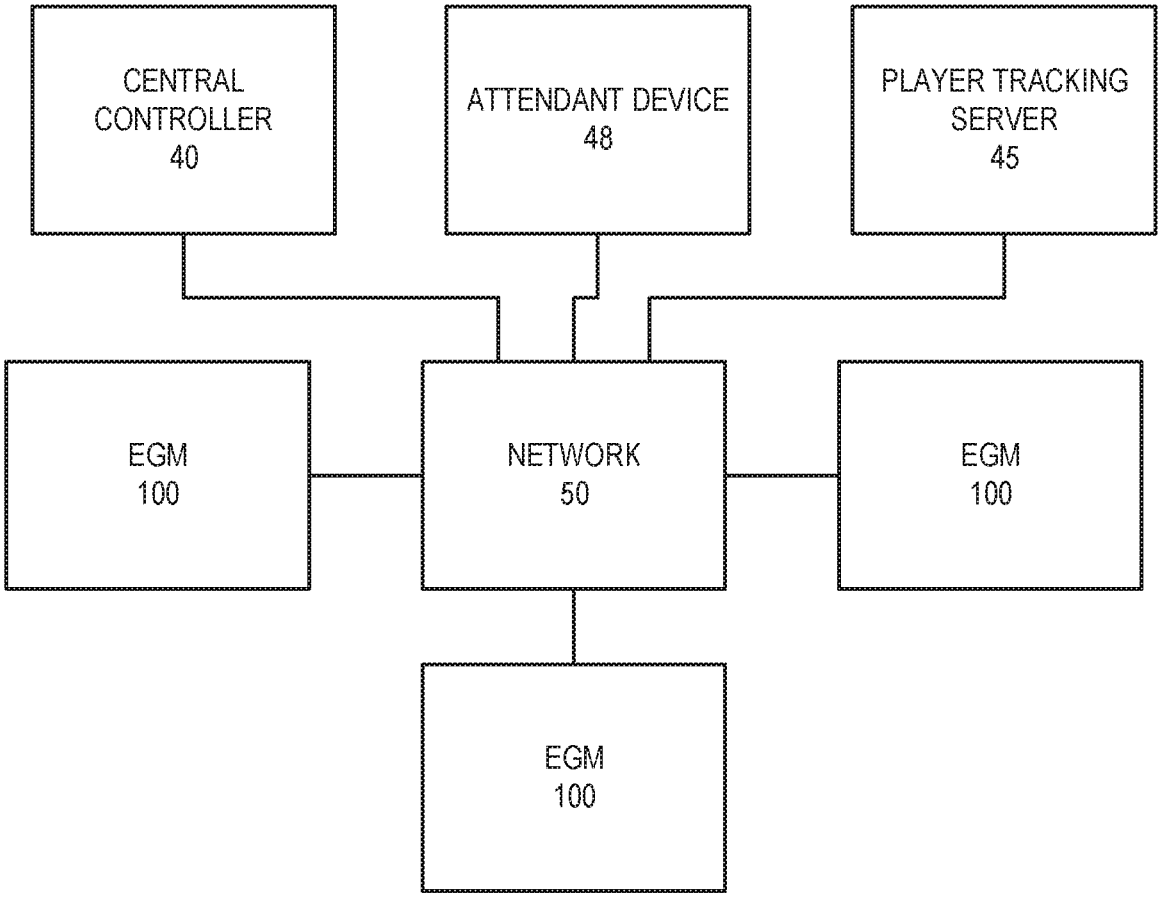
FIG. 2 is a schematic block diagram illustrating a network configuration for a plurality of gaming devices according to some embodiments.

Referring to FIG. 2, one or more EGMs 100 may be in communication with each other and/or at least one central controller 40 through a data network 50. The data network 50 may be a private data communication network that is operated, for example, by the gaming facility that operates the EGM 100. Communications over the data network 50 may be encrypted for security. The central controller 40 may be any suitable server or computing device which includes at least one processor and at least one memory or storage device. In different such embodiments, the central controller 40 is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central controller 40 is designed to transmit and receive events, messages, commands or any other suitable data or signal between the central controller 40 and each of the individual EGMs 100. The central controller 40 is operable to execute such communicated events, messages or commands in conjunction with the operation of the central server. It should be appreciated that one, more than one, or each of the functions of the central controller 40 as disclosed herein may be performed by one or more EGM processors. It should be further appreciated that one, more or each of the functions of one or more EGM processors as disclosed herein may be performed by the central controller 40.

A player tracking server 45 may also be connected through the data network 50. The player tracking server 45 may manage a player tracking account that tracks the player's gameplay and spending, manages loyalty awards for the player, manages funds deposited or advanced on behalf of the player, and other functions. In some embodiments of the inventive concepts, the player tracking server 45 also keeps track of a player's emotional state, and may also keep track of a threshold emotional state that is associated with a particular player. The player tracking server 45 may also store model information describing a player emotional state detection model and/or an emotional state prediction model as described herein.

An attendant device 48 may also be connected to the network 50. The attendant device 48 may be used by a floor attendant to monitor the operation of the EGMs 100, for example, to be notified when a problem with an EGM occurs.

Emotional State Management

Although gaming is considered by most players to provide relaxation and enjoyment, players of electronic gaming machines, and in particular players of electronic wagering machines, may experience frustration or stress when they lose. For example, players may experience frustration or stress if they encounter an extended losing streak or if they lose an amount of money that is greater than expected.

Embodiments of the inventive concepts provide electronic gaming machines that predict a player's emotional response to various game events, such as wins and losses. In particular, an EGM according to some embodiments may estimate the emotional state of a player using biometric information provided from one or more biometric units as described above and/or based on game play information, such as information about wins and losses, and/or environmental data. Such information is collectively referred to herein as "emotional state data." The emotional state data, including biometric information provided by the biometric device(s), may be used to generate one or more emotional state metrics that quantify a current emotional state of a player. The emotional state metrics may include a plurality of different metrics that provide a multi-dimensional assessment of a player's emotional state.

For example, in one embodiment, the emotional state metrics may include a first metric that estimates a level of positivity or negativity that the player is experiencing and a second metric that estimates a level of energy the player is exhibiting. These levels may be determined from any of the emotional state data. For example, an energy level of the player may be detected based on a speed or quickness of player hand or eye movements, button presses, etc. A level of positive or negative emotion may be detected using the microphone 125 based on pitch or timbre of the player's voice, or using the camera 127 by detecting whether a player is smiling or frowning, or whether their body movements are smooth and relaxed or jerky and agitated, etc. Strain gauges in the input buttons may detect if the player is striking the buttons with force, indicating positive emotion or gently pressing the buttons, indicating negative emotions.

Figure 3:
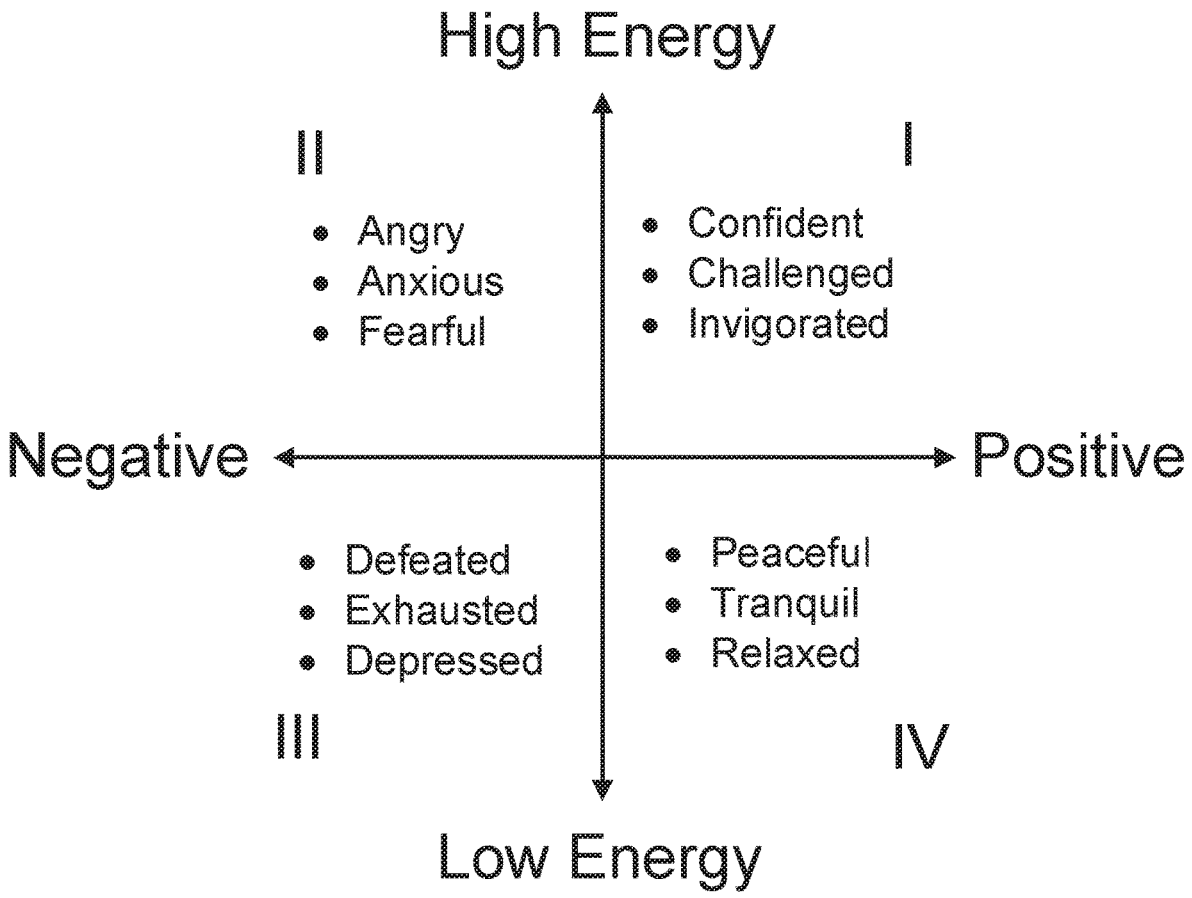
FIG. 3 illustrates a two-dimensional model of possible emotional states of a player.

Referring to FIG. 3, a model is depicted in which the player's emotional state is represented on a two-dimensional graph in which the player's level of positive or negative energy is plotted on one axis, (e.g., the x-axis) and the player's energy level is plotted on the other axis (e.g., the y-axis). As can be seen in FIG. 3, using this model, a player's emotional state will generally fall into one of four quadrants, in which quadrant I represents a high energy, positive emotional state, quadrant II represents a high energy, negative emotional state, quadrant III represents a low energy, negative emotional state, and quadrant IV represents a low energy, positive emotional state. Although only two dimensions are illustrated in FIG. 3, it will be appreciated that this model may be extended to additional dimensions.

Still referring to FIG. 3, a player's emotional state can be characterized by its position in one of the four quadrants shown. For example, a player whose emotional state is in quadrant I, i.e., a high energy, positive state, will likely feel confident, challenged and invigorated. Conversely, a player whose emotional state is in quadrant III, i.e., a low energy, negative state, will typically characterize their feelings as defeated, exhausted, and depressed. A player whose emotional state is in quadrant II, i.e., a high energy, negative state, will likely feel angry, anxious and fearful, while a player whose emotional state is in quadrant IV, i.e., a low energy positive state, will feel peaceful, relaxed and tranquil.

It will be further appreciated that a player's emotional state may have a direct bearing on whether the player is likely to continue playing a particular EGM. For example, when the player's emotional state is in quadrant I (high energy, positive), indicating that the player feels confident and invigorated, the player may be more likely to want to keep playing. Conversely, when the player's emotional state is in quadrant III (low energy, negative), the player will feel defeated and depressed, and may be unlikely to want to continue to play the EGM.

Embodiments of the inventive concepts adaptively learn how a player responds to various events, conditions and stimulants, including in-game and out-of-game events, conditions and stimulants, and predict how the player will react to various game events. Some embodiments may alter game events or the presentation of game events, with a goal of keeping the player's emotional state in a desired condition or urging the player's emotional state towards a desired condition, such as by encouraging the player into a more positive or more energetic emotional state from a more negative or less energetic emotional state.

Some further embodiments may alter game conditions, such as environmental conditions, with a goal of keeping the player's emotional state in a desired condition or urging the player's emotional state towards a desired condition. How the game events or environmental conditions are modified may be determined based on past experience with the player, for example, using a neural network to predict player emotional response, as will be described in more detail below.

Figure 4:
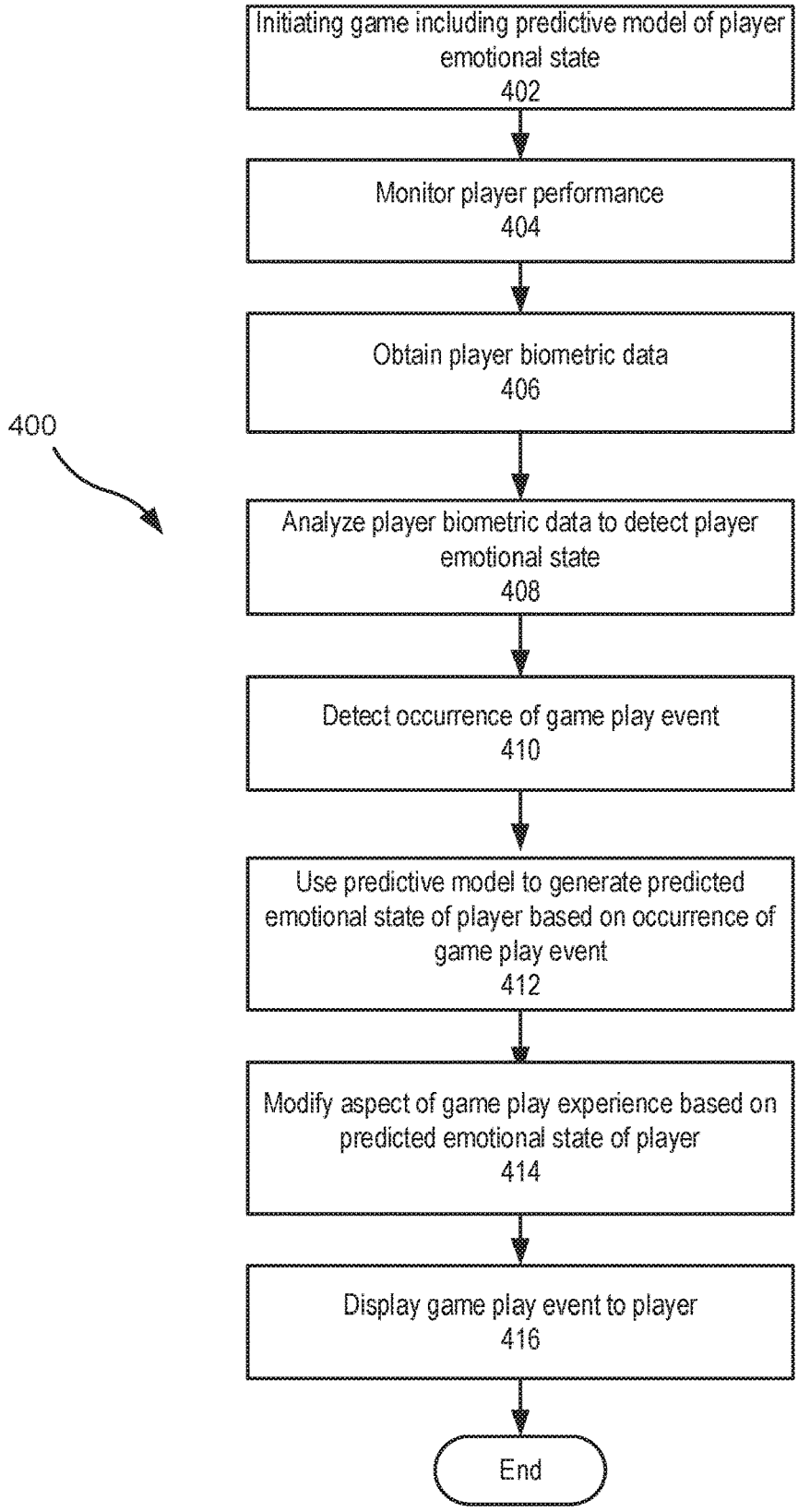
FIGS. 4, 5, 6 and 7 are process flow diagrams illustrating operations of systems/methods according to various embodiments.

FIG. 4 is a flowchart illustrating operations 400 that may be performed by an electronic gaming machine according to some embodiments. Referring to FIG. 4, a method 400 according to some embodiments includes initiating a game on an EGM 100 (block 402). The game includes a detection model for determining a current emotional state of the player, and a predictive model of an emotional state of a player of the EGM 100. The detection model and the predictive model each include a plurality of input parameters associated with operation of the electronic gaming machine by the player. The detection model may be implemented in the emotional state detection module 139A shown in FIG. 1D, while the predictive model may be implemented in the emotional state prediction module 139B shown in FIG. 1D.

Referring again to FIG. 4, the EGM 100 monitors the player's performance in the game (block 404) and obtains, via a biometric data input device, biometric data associated with the player while the player is engaged in using the electronic gaming machine (block 406). The EGM 100 may also collect other data relating to the player, including game play data and/or environmental data that may be used as inputs to the detection model and/or the predictive model. The EGM 100 analyzes the biometric data, game play data and/or environmental data using the detection model to detect an emotional state of the player while the player is engaged in using the EGM 100 (block 408). The detected emotional state of the player as an input parameter to the predictive model, as discussed in more detail below.

As the game is played, the EGM 100 detects the occurrence of a game play event, wherein the game play event is associated with one of the input parameters of the predictive model (block 410). The detected game play event may be an event that is expected to alter an emotional state of the player, and in particular may be an event that is expected to alter then emotional state of the player in a negative manner. Examples of negative game play events include a loss in a main game, a loss in a bonus game, a failure to complete a level in a game, a failure to accomplish a predetermined goal in a game, a string of losses in a game, a mistake in a skill-based portion of a game, etc.

In response to detecting the game play event, and before the game play event is actually displayed to the player, the systems/methods generate, via the predictive model, a predicted emotional state of the player as a result of the occurrence of the game play event (block 412). Based on the predicted emotional response of the player to the game play event, the systems/methods modify an aspect of a game play experience of the game (block 414), after which the systems/methods display the game play event to the player (block 416).

In particular, if the EGM 100 determines that the game play event will have a substantially negative impact on the player, the EGM 100 may modify the game play experience of the player to mitigate the emotional impact of the game play event on the player. The game play experience may be modified in a number of ways to mitigate the emotional impact of the game play event on the player. For example, the EGM 100 may change the music, sound, or lighting associated with a game in a way that improves the emotional state of the player, such as by playing more upbeat music or displaying an animation to the player following a loss. In some embodiments, the EGM 100 may display a bonus game to the player following a loss to mitigate the impact of the loss on the player's emotional state. In some embodiments, the EGM 100 may display a motivational message to the player.

Figure 5:
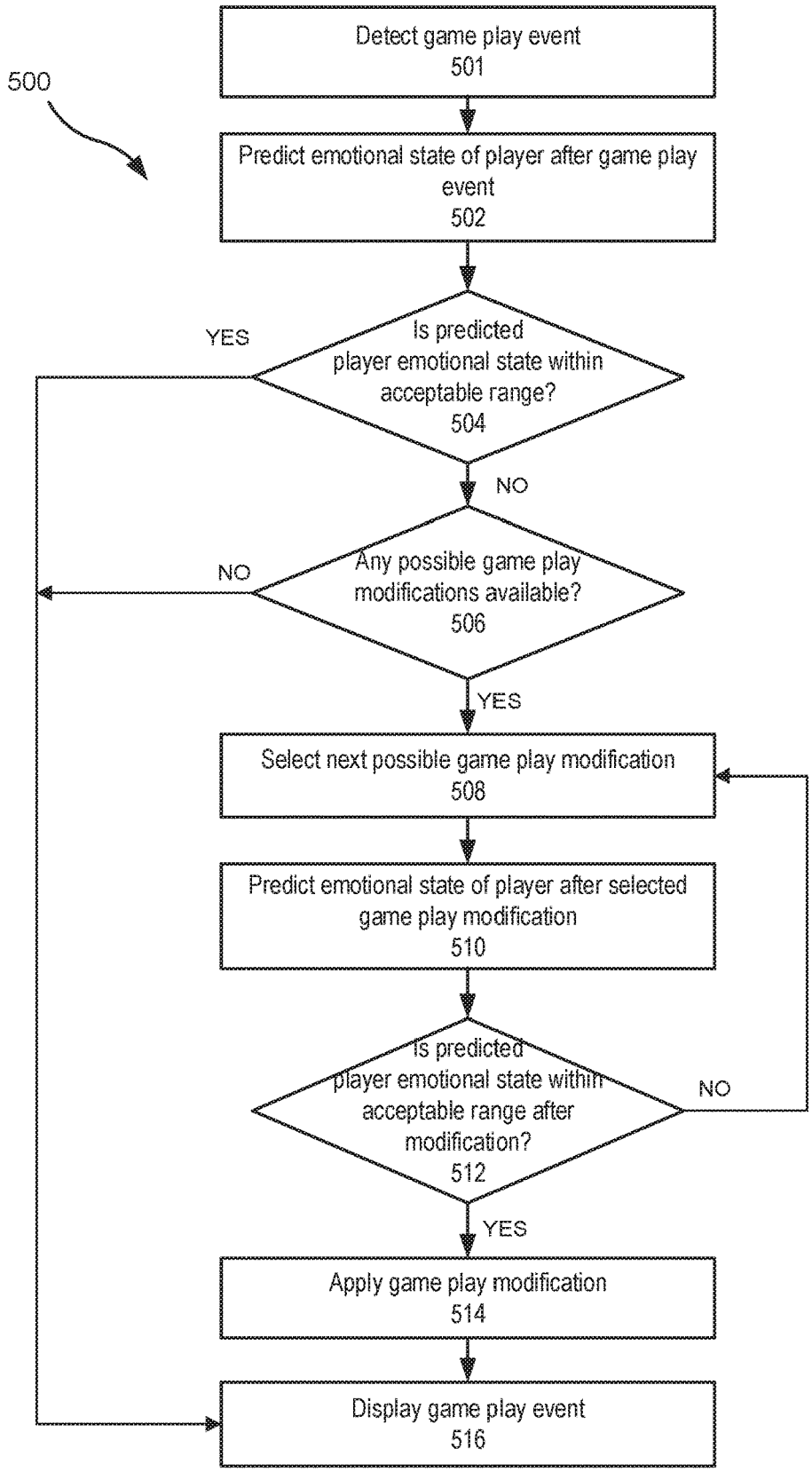

The EGM 100 may determine how to change the game play experience using the predictive model by checking various possible modifications to the game play experience to determine if the modification of the game play experience. For example, reference is made to FIG. 5, which is a flowchart illustrating operations an EGM 100 may take to determine how to adjust game play based on a player's emotional state. Referring to FIG. 5, the EGM 100 detects a game play event (block 501), and then predicts what the emotional state of the player will be after the game play event is displayed to the player (block 502). The EGM 100 then determines whether or not the player's predicted emotional state will be within an acceptable range (block 504). If so, the operations proceed to block 516, where the EGM 100 displays the game play event to the player. However, if the player's predicted emotional state is determined at block 504 to be outside an acceptable range, the EGM 100 determines at block 506 if there are any possible modifications that can be made to the player's game play experience to help mitigate the impact of the game play event on the player's emotional state. If not, the operations proceed to block 516, where the EGM 100 displays the game play event to the player. However, if there are changes that can be made to the game play experience, operations proceed to block 508, where the EGM 100 selects one of the possible modifications to the player's game play experience (e.g., changing the volume, type of music, lighting, sounds, of the game, offering a bonus game, offering player rewards or coupons, etc.) at block 508. The EGM 100 then predicts, at block 510, the impact of the modification of the game play experience by predicting the emotional state of the player following the game play event and the modification of the game play experience, for example, using the predictive model implemented using the emotional state prediction module 139B of FIG. 1D.

At block 512, the operations determine if the predicted emotional state of the player following the game play modification is within an acceptable range, and if so, applies the game play modification at block 514 and displays the game play event to the player at block 516. If the predicted emotional state of the player following the game play modification is not within an acceptable range, operations return to block 508, where the EGM 100 selects the next possible game play modification to check.

Modifying the aspect of the game play experience may include modifying one of a sound associated with the game play experience, a visual image associated with the game play experience, a bonus feature, a pay table, and an advertisement screen displayed on the electronic gaming machine.

The method may further include obtaining additional biometric data associated with the player after the occurrence of the game play event, analyzing the additional biometric data to detect an actual emotional state of the player after the occurrence of the game play event, comparing the actual emotional state of the player after the occurrence of the game play event with the predicted emotional state of the player as a result of the occurrence of the game play event, and modifying the predictive model based on comparison of the actual emotional state of the player after the occurrence of the game play event with the predicted emotional state of the player as a result of the occurrence of the game play event. In this manner, the predictive model of the player's emotional state may be improved based on the new information collected by the EGM following occurrence of the game play event. The game play event, and the player's reaction to the game play event, may thereby be seen as an adaptive learning event by which the player emotional state prediction model may be updated. Such recursive learning is a natural feature of an adaptive neural network model, as discussed in more detail below.

Figure 6:
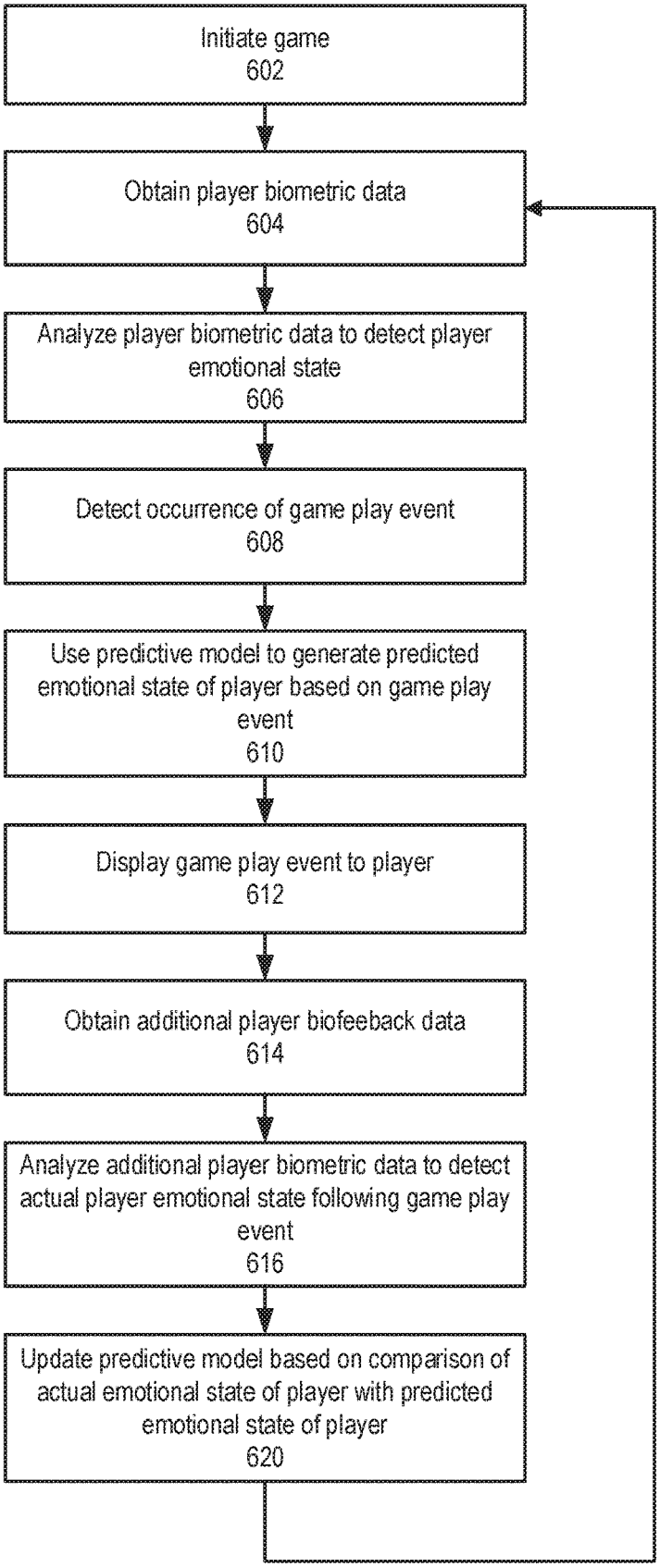

For example, referring to FIG. 6, the methods may include initiating a game on an EGM 100 (block 602). During game play, the EGM 100 obtains, via a biometric data input device, biometric data associated with the player while the player is engaged in using the electronic gaming machine (block 604). The EGM 100 may also collect other data relating to the player, including game play data and/or environmental data that may be used as inputs to the detection model and/or the predictive model. The EGM 100 analyzes the biometric data, game play data and/or environmental data using the detection model to detect an emotional state of the player while the player is engaged in using the EGM 100 (block 606). The detected emotional state of the player as an input parameter to the predictive model.

At block 608, the EGM 100 detects occurrence of a game play event, such as a win or loss. The EGM 100 uses the predictive model to generate a predicted emotional state of the player following the game play event (block 610). At block 612, the EGM 100 displays the game play event to the player, and subsequently at block 614 collects additional biometric data from the player. The EGM 100 analyzes the additional biometric data at block 616 using the emotional state detection model to estimate the player's actual emotional state following the game play event. At block 618, the systems/methods compare the actual emotional state of the player with the predicted emotional state generated at block 610, and at block 620, the systems/methods update the predictive model based on the comparison. In this manner, the EGM 100 may "learn" how the player's emotional state responds to various changes in the game play experience, such as changes in the environment (e.g., ambient light, sound or music), game play, bonus frequency, pay table, game speed, or any other aspect of game play.

Figure 7:
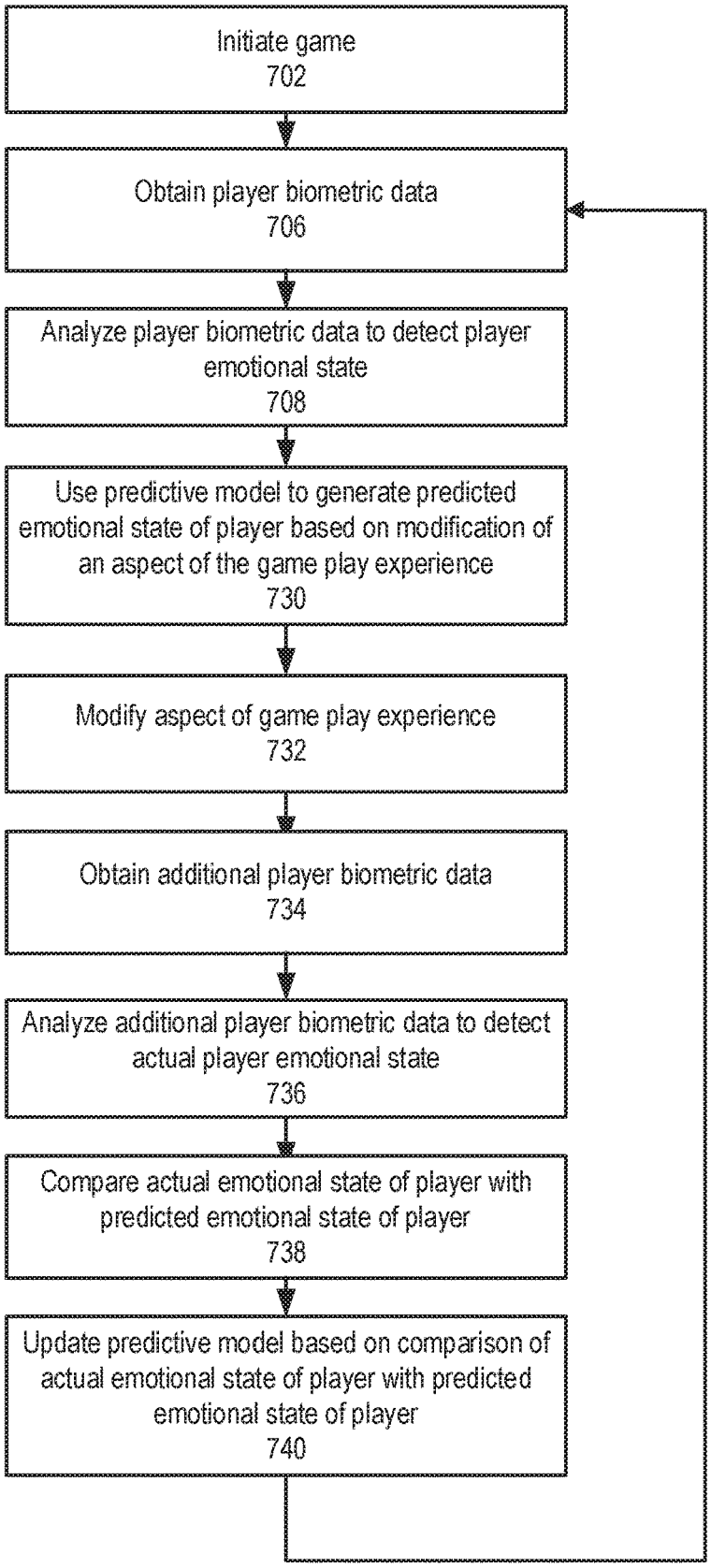

In some embodiments, the EGM 100 may, from time to time, adapt various aspects of a game play experience, observe the player's emotional response to the adaptation, and update its emotional state detection and/or prediction models accordingly. For example, referring to FIG. 7, operations according to further embodiments are illustrated. As shown therein, the operations may include initiating a game on an EGM 100 (block 702). During game play, the EGM 100 obtains, via a biometric data input device, biometric data associated with the player while the player is engaged in using the electronic gaming machine (block 706). The EGM 100 may also collect other data relating to the player, including game play data and/or environmental data that may be used as inputs to the detection model and/or the predictive model. The EGM 100 analyzes the biometric data, game play data and/or environmental data using the detection model to detect an emotional state of the player while the player is engaged in using the EGM 100 (block 708). The detected emotional state of the player as an input parameter to the predictive model.

As the game is played, the EGM 100 may change the game play experience presented to the player and observe the player's emotional response to the change in game play experience. Based on the modification to the game play experience, the EGM 100 uses the predictive model to generate a predicted emotional state of the player following the modification of the game play experience (block 730). At block 732, the EGM 100 modifies the game play experience, and subsequently at block 734 collects additional biometric data from the player. The EGM 100 analyzes the additional biometric data at block 736 using the emotional state detection model to estimate the player's actual emotional state following modification of the game play experience. At block 738, the systems/methods compare the actual emotional state of the player with the predicted emotional state generated at block 730, and at block 740, the systems/methods update the predictive model based on the comparison.

In some embodiments, the method may further include comparing the predicted emotional state of the player to a threshold, and notifying an attendant device 48 and/or a central controller 40 through the network 50 (FIG. 2) of the predicted emotional state of the player in response comparing the predicted emotional state of the player to the threshold, so that the casino operator can be aware of a potential issue.

Artificial Neural Network Model

Both the emotional state detection model implemented by the emotional state detection module 139A and the emotional state prediction model implemented by the emotional state prediction module 139B shown in FIG. 1D may be implemented using an artificial neural network. An artificial neural network is a computing system having a structure that is inspired by biological neural networks. Such systems may "learn" how to process input data by considering a priori known examples of input vectors and automatically adapting the network to produce the same results. An artificial neural network is based on a collection of connected units or nodes which act as artificial neurons and are connected by a mesh of connectors which simulate synapses. Each connection between nodes can transmit a signal from one node to another. The artificial neuron that receives the signal can process it and then signal artificial neurons connected to it.

In a typical artificial neural network implementation, the signal at a connection between nodes is a real number, and the output of each node is calculated by a non-linear function of the sum of its inputs. Such a function is referred to herein as a "combinational function" because it combines the outputs of other nodes. Nodes and/or connections typically have a weight that adjusts as learning proceeds. The weight increases or decreases the strength of the signal at a connection. The nodes may have a threshold such that a signal is sent only if the aggregate signal exceeds that threshold. Typically, nodes are organized in layers, where different layers may perform different kinds of transformations on their inputs. Signals travel from the first (input) layer of nodes, to the last (output) layer of nodes. "Learning" or training of artificial neural networks is typically performed by a process of backpropagation in which known outcomes are propagated back through the network, and the weights are adjusted according to a gradient function so that the system produces the known outcome in response to a particular input state, where an "input state" is the vector of input parameter values. Backpropagation can be considered a supervised training technique, because it uses a known output state for each input state that is trained.

Figure 8:
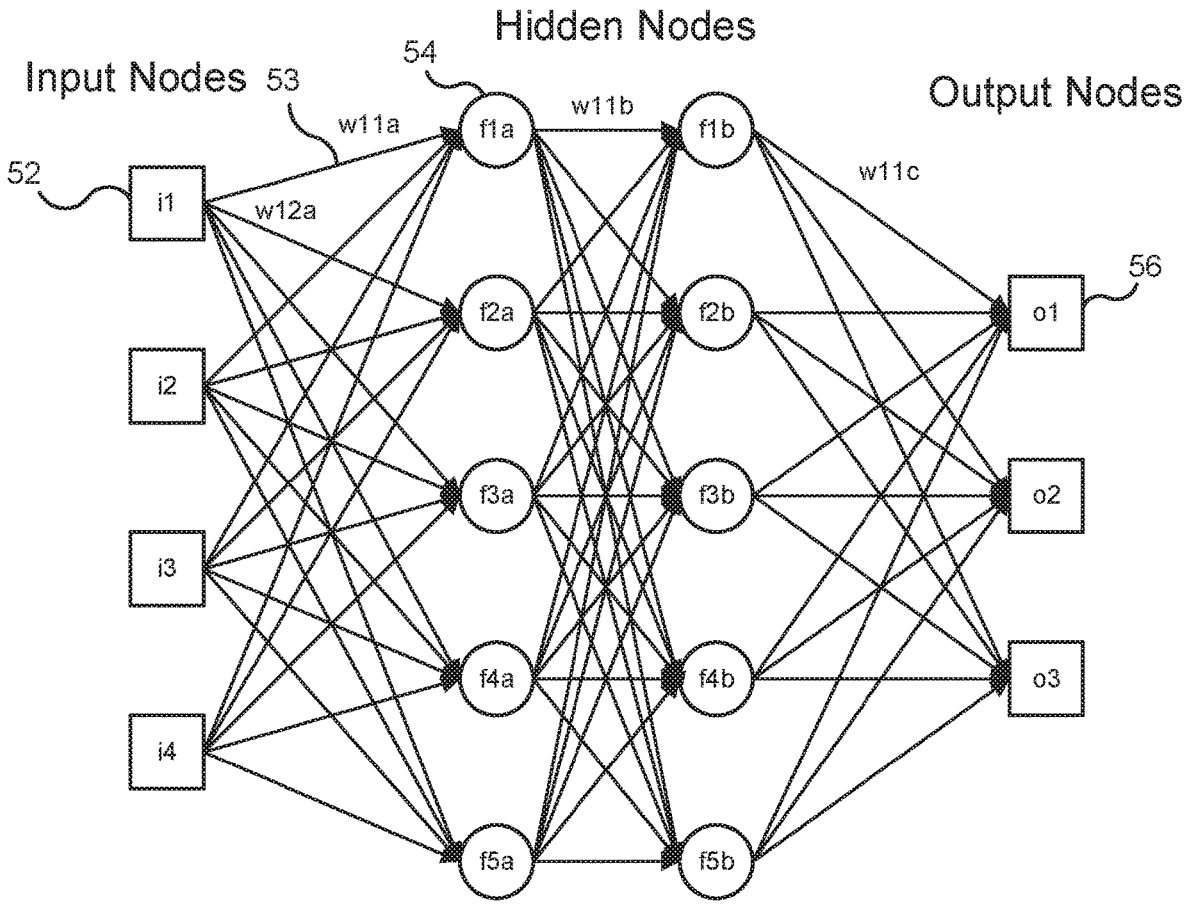
FIG. 8 illustrates a neural network model that may be used to predict an emotional state of a player according to some embodiments.

A simplified example of an artificial neural network is shown in FIG. 8. Referring to FIG. 8, an artificial neural network includes a plurality of input nodes 52 corresponding to a plurality of input parameters, a plurality of hidden nodes 54 coupled to the plurality of input nodes 52 by means of a plurality of connectors 53, and a plurality of output nodes 56 coupled to the plurality of hidden nodes 54, each of the plurality of hidden nodes having an associated combinational function and each of the connectors having an associated weight. Although two levels of hidden nodes are shown in FIG. 8, more levels of hidden nodes may be provided. Moreover, more or fewer input nodes and/or output nodes may be provided than are shown in FIG. 8. At least some of the plurality of output nodes associated with an emotional state of the player. For example, one of the output nodes may indicate a level of energy of the player, one of the output nodes may indicate a level of stress of the player, one of the output nodes may indicate a level of positivity/negativity of the player, etc.

The inputs may correspond to one or more aspects of the player, the environment, and/or the current game play that are considered to possibly affect or indicate the player's emotional state. For example, some of the inputs may correspond to biofeedback data obtained from the player, while others may correspond to the level of ambient light or sound, the volume level of the game, the player's win/loss record, most recent game outcome, etc. Each of the inputs is assigned a numerical value at the corresponding input node. A weight is applied to each input parameter when it is propagated to a node at the next level of the model. For example, a weight w11a is applied to the parameter at input node i1 before it is applied to the node f1a. Likewise, a weight w12a is applied to the parameter at input node i1 before it is applied to the node f2a. At each node, the weighted inputs received at that node are processed by a combinational function, such as f1a, f2a, etc., and the output of the node is subsequently weighted applied to nodes in the next level. At the output node, the outputs of the hidden nodes are optionally weighted again and combined to provide outputs.

Figure 9A:
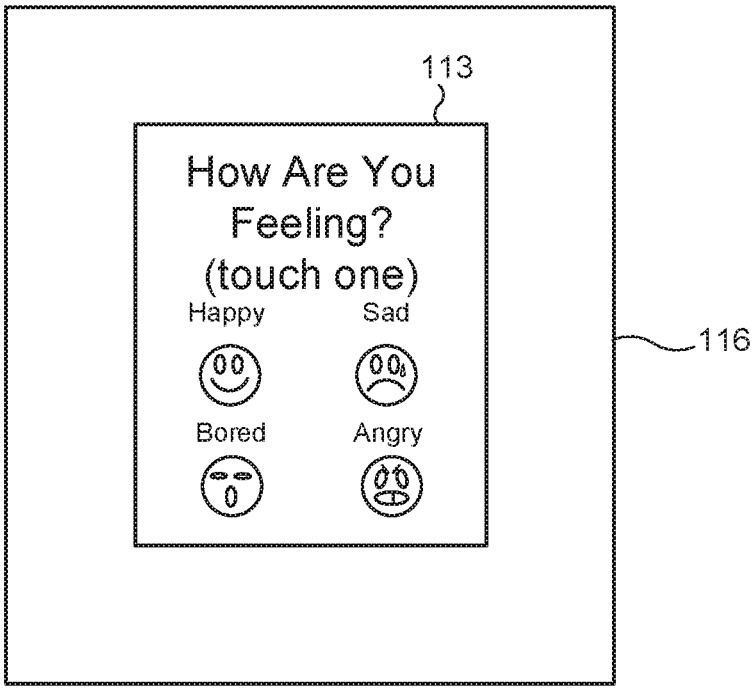
FIGS. 9A and 9B illustrate visual prompts that may be presented to a player to obtain feedback about the player's emotional state.
Figure 9B:
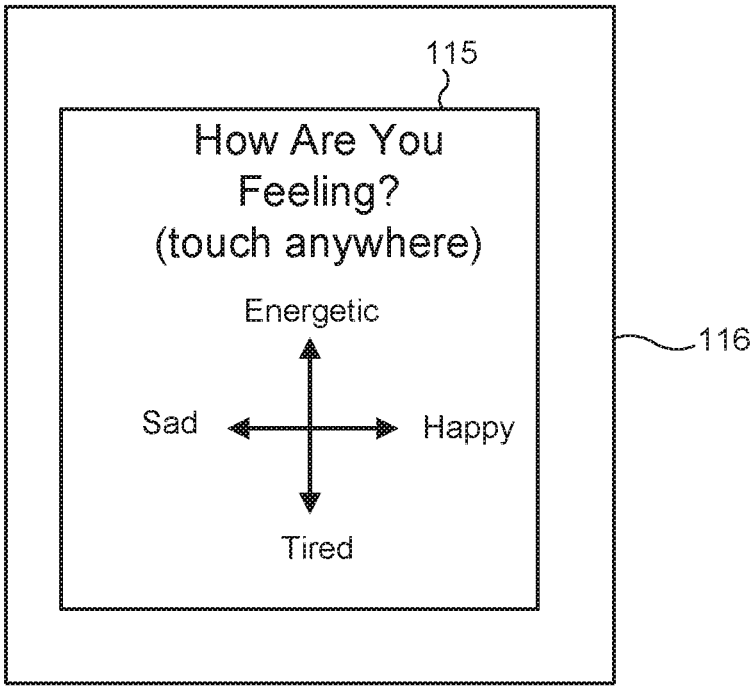

The emotional state detection model may be initially trained by testing a group of subjects during game play and asking them from time to time to describe their emotional state. This may be done, for example, but asking the subject to rate their emotional state. Once a basic model has been trained, the model may be further refined for an individual player by asking the player to rate his or her emotional state. In some embodiments, the player may be asked to rate their emotional state by selecting an icon that represents their current emotional state. For example, FIG. 9A illustrates a screen that may be displayed on a touch-screen display during training to rate a player's emotional state as happy, sad, bored, angry, etc. The player is prompted to select or touch the icon that represents their current emotional state. This information is then backpropagated into the neural network model. The weights of the model are adjusted in the backpropagation process so that the current inputs will produce the selected output. Referring to FIG. 9B, in some embodiments, the player may be asked to touch a location on the screen represented by a two-dimensional space that corresponds to their current emotional state in terms of both high and low energy and positive or negative feeling, or other emotional dimensions.

Figure 10:
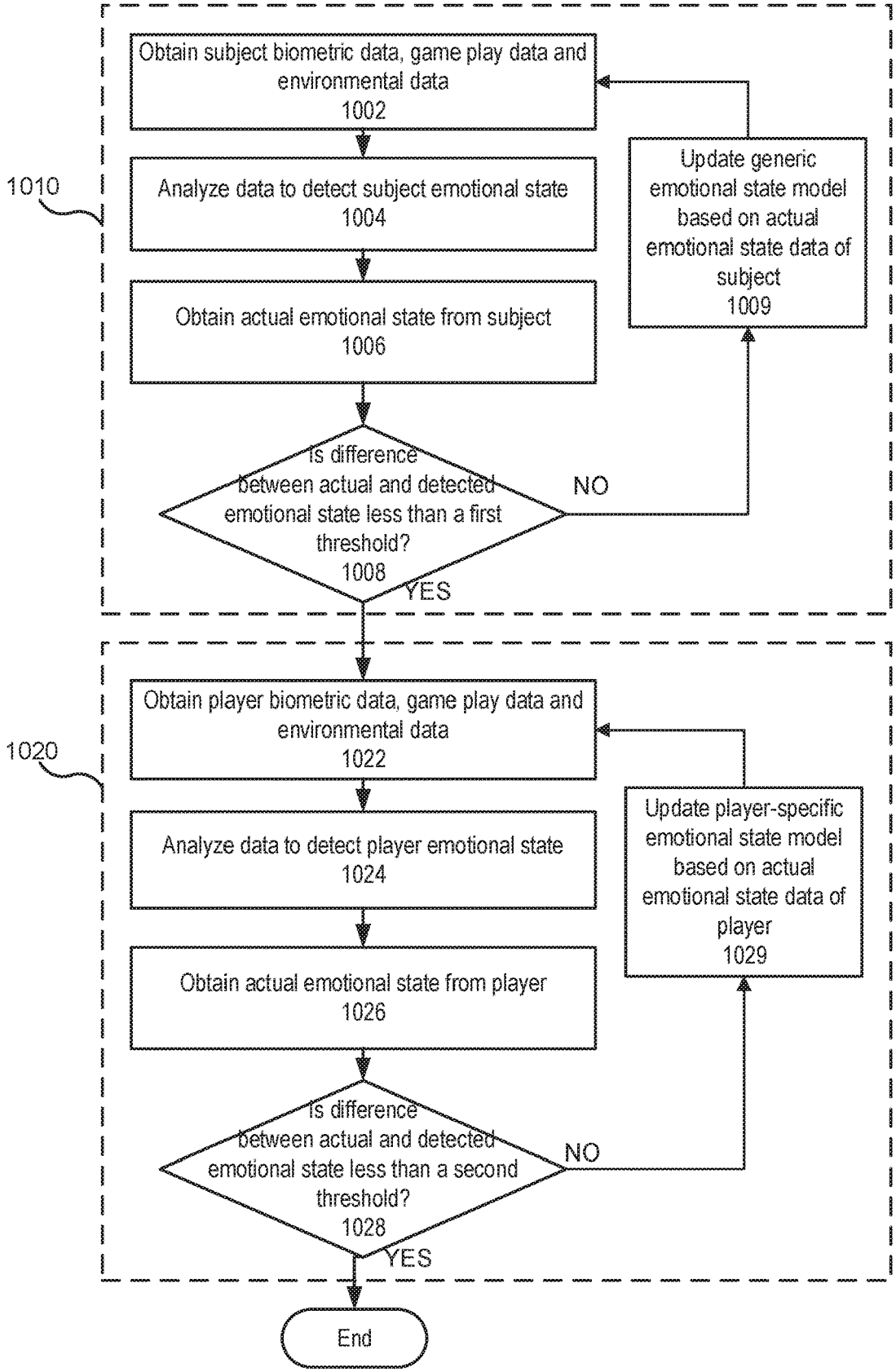
FIGS. 10 and 11 are process flow diagrams illustrating operations of systems/methods according to various embodiments.

FIG. 10 illustrates a training flowchart that includes a first process 1010 for generating a generic emotional state detection model and a second process for refining the generic emotional state detection model to generate a player-specific emotional state detection model. The systems/methods executing the first process 1010 use training data from a plurality of subjects, such as test players. The systems/methods obtain biometric data from the subject along with game play data and environmental data as the subject plays the game (block 1002). The systems/methods then analyze the data to detect the emotional state of the subject (block 1004). Next, the systems/methods obtain actual emotional state information from the subject, such as by prompting the subject to describe their emotional state as described above with reference to FIGS. 9A and 9B (block 1006). The systems/methods then determine if the difference between the actual and detected emotional states is less than a first threshold, and if so, initial training is complete, and the first process 1010 outputs a generic emotional state detection model. If the difference between the actual and detected emotional states is greater than the first threshold, the systems/methods update the generic emotional state model based on the actual emotional state (block 1009), and operations return to block 1002, where the systems/methods collect additional data to analyze. The process may be continued until the model is trained to within an accuracy represented by the first threshold. A plurality of generic emotional state detection models may be created by segregating the testing data based on various criteria, such as the subject's age, gender, race, marital status, income, education, etc. For example, a set of different generic emotional state models may be created for men and women, for younger players and older players, etc.

Once a generic emotional state detection model has been created using the first process 1010, a second process 1020 may be applied to customize the generic emotional state detection model for a particular player. A generic emotional state detection model that best fits the player is selected from the set of generic emotional state detection models developed in the first process 1010 and is provided as an input to the second process 1020. In the second process 1020, the systems/methods obtain biometric data from the player along with game play data and environmental data as the player plays the game (block 1022). The systems/methods then analyze the data to detect the emotional state of the player (block 1024). Next, the systems/methods obtain actual emotional state information from the player, such as by prompting the player to describe their emotional state as described above with reference to FIGS. 9A and 9B (block 1026). The systems/methods then determine if the difference between the actual and detected emotional states is less than a second threshold, and if so, training of the player-specific emotional state detection model is complete, and the second process 1010 outputs the player-specific emotional state detection model. If the difference between the actual and detected emotional states is greater than the second threshold, operations return to block 1022, where the systems/methods collect additional data from the player to analyze. The process may be repeated until the model is trained to within an accuracy represented by the second threshold. Since the second process is training with respect to a particular player, the second threshold may be smaller than the first threshold.

Figure 11:
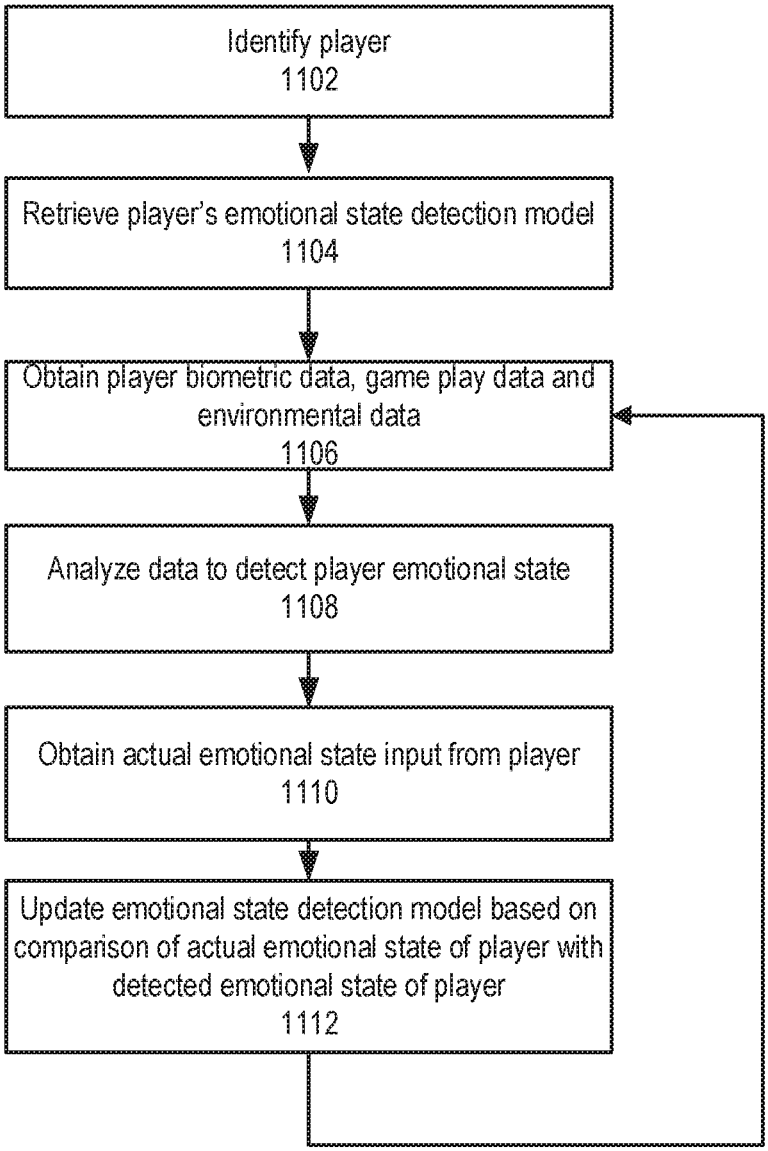

The player-specific emotional state detection model generated by the second process may be saved along with other player data in the player tracking server 45 (FIG. 2) so that it can be retrieved and used in subsequent gaming sessions. The player-specific emotional state detection model may be updated as the system learns more and more about the player's behavior and/or as the player's behavior changes over time. For example, referring to FIG. 11, when a player starts playing an EGM 100, the EGM 100 may identify the player, for example, by the use of a player tracking card, facial recognition or any other identification method (block 1102). Based on the player identification, the EGM 100 retrieves the player-specific emotional state detection model from the player tracking server 45 (block 1104), and loads the player-specific emotional state detection model into the emotional state detection module 139A (FIG. 1D). The EGM 100 may also retrieve a player-specific emotional state prediction model from the player tracking server 45 and load the player-specific emotional state prediction model into the emotional state prediction module 139B. As the player plays a game on the EGM 100, the EGM 100 collects player biometric data along with game play data and environmental data (block 1106) and analyzes the data to estimate the player's emotional state using the player-specific emotional state detection model (block 1108). From time to time, the EGM 100 may collect actual emotional state data from the player (1110) and update the emotional state detection model based on comparison of the player's actual emotional state with the emotional state detected by the emotional state detection model (block 1112). This process may be repeated from time to time to continually update the model.

As discussed above with respect to FIG. 6, some embodiments modify an emotional state prediction module by obtaining biometric data associated with the player after the occurrence of a game play event, analyzing the additional biometric data to detect an actual emotional state of the player after the occurrence of the game play event, comparing the actual emotional state of the player after the occurrence of the game play event with the predicted emotional state of the player as a result of the occurrence of the game play event, and modifying the predictive model based on comparison of the actual emotional state of the player after the occurrence of the game play event with the predicted emotional state of the player as a result of the occurrence of the game play event. When the emotional state detection model and/or the emotional state prediction model employs an artificial neural network, modifying the emotional state detection model and/or the emotional state prediction model may include modifying one of the combinational functions and/or one of the connector weights based on comparison of the actual emotional state of the player after the occurrence of the game play event with the predicted emotional state of the player as a result of the occurrence of the game play event.

In addition, when the emotional state detection model and/or the emotional state prediction model employs an artificial neural network, the input parameters include one of player age, player gender, player nationality, average wager, most recent amount wagered, wagering unit, total coin-in, total amount won, total amount lost, most recent win, most recent loss, duration of gaming session, bonus games played, pay table type, game type, ambient lighting, ambient temperature, ambient noise, and play speed.

Additional Features and Embodiments

In some embodiments, the biometric input device(s) may be used to estimate blood alcohol content (BAC) level of the player. Accordingly, in some embodiments the method may further include determining an estimated blood alcohol content (BAC) level of the player, and the input parameters of the emotional state detection model and/or the emotional state prediction model include the BAC level. The player's BAC level may be estimated in some embodiments by determining an alcoholic drink having an alcohol content served to the player, and determining, based in part on the alcohol content of the alcoholic drink, the estimated BAC level of the player. Further, determining the estimated BAC level may include determining a reaction time of the player in real time, and determining, based in part on the reaction time of the first player, the estimated BAC level of the player.

An electronic gaming machine according to some embodiments includes a processor, and a biometric input device coupled to the processor and configured to obtain biometric data associated with a player while the player is engaged in using the electronic gaming machine. The processor is configured to perform operations including providing a predictive model of an emotional state of a player of an electronic gaming machine, wherein the predictive model includes a plurality of input parameters associated with operation of the electronic gaming machine by the player, analyzing the biometric data to detect an emotional state of the player while the player is engaged in using the electronic gaming machine, providing the detected emotional state of the player as an input parameter to the predictive model, detecting occurrence of a game play event of the electronic device, wherein the game play event is associated with one of the input parameters of the predictive model, generating, via the predictive model, a predicted emotional state of the player as a result of the occurrence of the game play event, and modifying an aspect of a game play experience of the electronic gaming machine based on the predicted emotional state of the player.

The processor is further configured to display the game play event to the player, and to modify the aspect of the game play experience before displaying the game play event to the player.

Regardless of how much a player enjoys a gaming experience, it is inevitable that at some point the player will leave the EGM. In that situation, systems/methods described herein can also improve the "goodbye" experience for the player. The casino operator has a unique time in which although, it cannot keep the player at the machine anymore, can try to provide a new, inter-casino, destination. The casino operator may, based on its experience with a specific player, determine when the player is getting ready to leave and capitalize on that by suggesting to the player good deals within the casino they should take advantage of (such as a steak dinner deal), such as, for example, displaying information to the player on a secondary screen of the EGM 100. For example, if the EGM 100 expected the player to leave soon (within some time threshold) it could then start displaying advertisements for various casino attractions (such as food, shopping, etc.).

This could also be later expanded to include connectivity to the player via cell phone and sending advertisements there. This would allow the phone application to make the decisions on which advertisements to show based on inter-casino location or some other mechanism.

Secondary screen content is another potential tool that can be used to affect an individual player's mood. It is possible that one player may like to see progressive values (if applicable) and another enjoys having casino advertising showing on the secondary screen. Through learning about individual players, the EGM 100 can ensure that the secondary screen content is always something that is enjoyable for the particular player at the machine.

This can include dynamic visual content to adjust the whole gameplay layout to the player's preference. In the above example (about progressive values) the EGM 100 could adjust the screen layout so the progressive values were displayed on the main screen instead of the top screen for one player, but shown as a thumbnail that can be expanded and viewed for a player that does not seem to like them.

Accordingly, some embodiments of the inventive concepts may provide a fully "configurable" game platform for a player, due to the EGM's knowledge of a player's preferences. This may result in a gameplay experience where the player is only seeing things they enjoy and are not bothered by things that seem to impact their mood negatively.

Another application of the inventive concepts described herein is to use what we know about the individual player to suggest other games available on the machine that have learned they usually prefer. For example, a game chooser/game selection screen can be enhanced by the EGM's knowledge of the current player's emotional response by showing games that the system thinks the player will like based on their past mood fluctuations in games with certain criteria. For example, the EGM could learn that a certain player tends towards progressive games, or games with animals, or any other criteria and shows those games first in the chooser.

The overall gaming environment can also have an impact on player mood. An EGM according to some embodiments can utilize information it knows about the surroundings to make suggestions to the casino to improve the mood of individual players.

An EGM according to some embodiments may also have the ability to detect or otherwise determine a player's age and/or gender, which can be used to leverage advertisements based on age group and/or gender. This information will be especially helpful as the EGM first starts learning about a player, since no other, or very little other, specific information about the player may be known. This may help the EGM to have a better starting point to learn from given preexisting trends within different age demographics.

An example of a casino environment variable is cocktails. An EGM can know, using image recognition, when a cocktail arrives and can determine the player's mood shortly after that to determine if the player had a positive or negative experience. As the EGM learns about the player, it can determine if a player prefers male or female servers, older or younger, or which specific casino employee they prefer. With this information the emotional state detection and prediction models can be better customized to fit an individual player. Moreover, the EGM can notify a host system, which can be make changes accordingly to accommodate individual players.

Following receiving and/or finishing a cocktail, the EGM 100 can determine if a player then enjoys the gameplay more, changes their betting strategy, is a more volatile player, etc., and the system can change the game play experience accordingly to improve player mood. The EGM can also notify the host system to adjust cocktail frequency to better accommodate the player.

An EGM configured according to various embodiments described herein can impact of many casino environment factors on a player's emotional state, such as: sitting next to people, music in the casino, lighting in the casino, smoke in the air, frequency of cocktails, seeing/hearing other people on EGMs win, etc. All of this information can be processed to give the EGM an overall understanding of how a casino can adjust to better suit its players. The EGM and/or the host system can then adjust one or more environmental parameters automatically according to individual player preferences.

In addition, as the EGM learns about a player, it can start to give the player a more unique, enjoyable gaming experience. By leveraging player rewards card technology as well as facial recognition technology, the EGM can uniquely identify a player. With that information, the EGM can customize an artificial neural network with that player's parameters to increase our probability of giving the player a better gaming experience.

The player information may be stored on a host system, such as the player tracking server 45 (FIG. 2) so all EGMs within a casino can have access to information about each player. When applicable, the information will be stored with an associated player loyalty account so that it may be quickly and easily accessed by the EGM and/or the host system. When that information is not available, it may nevertheless be possible to determine a player's identity through facial recognition. The existing emotional state detection systems typically include facial recognition capabilities. In the event that a new player sits down, a new neural network model can be created for that player, and all relevant information may be stored in a host system.

Further Definitions

As used herein, an electronic gaming machine (EGM) includes any electronic device on which an electronic game may be played, including a standalone system such as a slot machine, a handheld gaming device, a desktop computing device, or any other computing device on which an electronic game may be played. As will be appreciated by one of skill in the art, the present inventive concepts may be embodied as a method, data processing system, and/or computer program product. Accordingly, the present invention may take the form of an entirely hardware embodiment, an entirely software embodiment or an embodiment combining software and hardware aspects all generally referred to herein as a "circuit" or "module." Furthermore, the present invention may take the form of a computer program product on a tangible computer usable storage medium having computer program code embodied in the medium that can be executed by a computer. Any suitable tangible computer readable medium may be utilized including hard disks, CD ROMs, optical storage devices, or magnetic storage devices.

The embodiments described herein provide useful physical machines and particularly configured computer hardware arrangements of computing devices, servers, electronic gaming terminals, processors, memory, networks, for example. Components of the computer may include, but are not limited to, a processing unit including a processor circuit, such as a programmable microprocessor or microcontroller, a system memory, and a system bus that couples various system components including the system memory to the processing unit.

The processor circuit may be a multi-core processor including two or more independent processing units. Each of the cores in the processor circuit may support multi-threading operations, i.e., may have the capability to execute multiple processes or threads concurrently. Additionally, the processor circuit may have an on-board memory cache. An example of a suitable multi-core, multithreaded processor circuit is an Intel Core i7-7920HQ processor, which has four cores that support eight threads each and has an 8 MB on-board cache. In general, the processor circuit may, for example, include any type of general-purpose microprocessor or microcontroller, a digital signal processing (DSP) processor, an integrated circuit, a field programmable gate array (FPGA), a reconfigurable processor, a programmable read-only memory (PROM), or any combination thereof.

The system bus may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

The computer typically includes a variety of computer readable media. Computer readable media can be any available media that can be accessed by computer and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic disk storage or other magnetic storage devices, or any other medium which can be used to store the desired information and which can accessed by the computer. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

The system memory includes computer storage media in the form of volatile and/or nonvolatile memory such as read only memory (ROM) and random access memory (RAM). A basic input/output system (BIOS), containing the basic routines that help to transfer information between elements within the computer, such as during start-up, is typically stored in the ROM. The RAM typically contains data and/or program modules that are immediately accessible to and/or presently being operated on by the processing unit. The system memory may store an operating system, application programs, other program modules, and program data.

The computer may also include other removable/non-removable, volatile/nonvolatile computer storage media. By way of example only, the computer may include a hard disk drive reads from or writes to non-removable, nonvolatile magnetic media, a magnetic disk drive that reads from or writes to a removable, nonvolatile magnetic disk, and/or an optical disk drive that reads from or writes to a removable, nonvolatile optical disk such as a CD ROM or other optical media. Other removable/non-removable, volatile/nonvolatile computer storage media that can be used in the illustrative operating environment include, but are not limited to, magnetic tape cassettes, flash memory cards, digital versatile disks, digital video tape, solid state RAM, solid state ROM, and the like. The hard disk drive is typically connected to the system bus through a non-removable memory interface.

The drives and their associated computer storage media discussed above provide storage of computer readable instructions, data structures, program modules and other data for the computer. A user may enter commands and information into the computer through input devices such as a keyboard and pointing device, commonly referred to as a mouse, trackball or touch pad. Other input devices (not shown) may include a microphone, joystick, game pad, satellite dish, scanner, touchscreen, or the like. These and other input devices are often connected to the processing unit through a user input interface that is coupled to the system bus, but may be connected by other interface and bus structures, such as a parallel port, game port or a universal serial bus (USB). A monitor or other type of display device is also connected to the system bus via an interface, such as a video interface. In addition to the monitor, computers may also include other peripheral output devices such as speakers and a printer, which may be connected through an output peripheral interface.

The computer may operate in a networked environment using logical connections to one or more remote computers, such as a remote computer. The remote computer may be a personal computer, a server, a router, a network PC, a peer device or other common network node, and typically includes many or all of the elements described above relative to the computer. The logical connections include a local area network (LAN) connection and a wide area network (WAN) connection, but may also include other networks. Such networking environments are commonplace in offices, enterprise-wide computer networks, intranets and the Internet.

When used in a LAN networking environment, the computer may be connected to the LAN through a network interface or adapter. When used in a WAN networking environment, the computer may include a modem or other means for establishing communications over the WAN. The modem, which may be internal or external, may be connected to the system bus via the user input interface, or other appropriate mechanism.

Some embodiments of the present invention are described herein with reference to flowchart illustrations and/or block diagrams of methods, systems and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable memory that can direct a computer or other programmable data processing apparatus to function in a particular manner, such that the instructions stored in the computer readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved. Although some of the diagrams include arrows on communication paths to show a primary direction of communication, it is to be understood that communication may occur in the opposite direction to the depicted arrows.

Computer program code for carrying out operations of the present invention may be written in an object oriented programming language such as Java®, Smalltalk or C++. However, the computer program code for carrying out operations of the present invention may also be written in conventional procedural programming languages, such as the "C" programming language. The program code may execute entirely on the user's computer, partly on the user's computer, as a stand alone software package, partly on the user's computer and partly on a remote computer or entirely on the remote computer. In the latter scenario, the remote computer may be connected to the user's computer through a local area network (LAN) or a wide area network (WAN), or the connection may be made to an external computer (for example, through the Internet using an Internet Service Provider).

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed typical embodiments and, although specific terms are employed, they are used in a generic and descriptive sense only and not for purposes of limitation, the scope of the inventive concepts being set forth in the following claims.

What is claimed is:

1. A computer-implemented method, comprising:

providing a predictive model of an emotional state of a player of an electronic gaming machine, wherein the predictive model is usable to generate a predicted emotional state of the player based on a game-play input parameter associated with operation of the electronic gaming machine and a detected-emotion input parameter associated with a detected emotional state of the player;

obtaining, via a biometric data input device, biometric data associated with the player while the player is engaged in using the electronic gaming machine;

analyzing the biometric data to detect an emotional state of the player while the player is engaged in using the electronic gaming machine;

providing the detected emotional state of the player as the detected-emotion input parameter to the predictive model;

detecting a triggering of an occurrence of a game play event of the electronic gaming machine, wherein the game play event is associated with the game-play input parameter of the predictive model;

generating, via the predictive model and prior to execution of the game play event, a predicted emotional state of the player as a result of the occurrence of the game play event; and modifying an aspect of a game play experience of the electronic gaming machine based on the predicted emotional state of the player.

2. The computer-implemented method of claim 1, further comprising displaying the game play event to the player, wherein modifying the aspect of the game play experience is performed before displaying the game play event to the player.

3. The computer-implemented method of claim 1, further comprising:

obtaining additional biometric data associated with the player after the occurrence of the game play event;

analyzing the additional biometric data to detect an actual emotional state of the player after the occurrence of the game play event;

comparing the actual emotional state of the player after the occurrence of the game play event with the predicted emotional state of the player as a result of the occurrence of the game play event; and modifying the predictive model based on comparison of the actual emotional state of the player after the occurrence of the game play event with the predicted emotional state of the player as a result of the occurrence of the game play event.

4. The computer-implemented method of claim 1, wherein modifying the aspect of the game play experience comprises modifying one of: a sound associated with the game play experience; a visual image associated with the game play experience; a bonus feature; a pay table; and an advertisement screen displayed on the electronic gaming machine.

5. The computer-implemented method of claim 1, further comprising:

comparing the predicted emotional state of the player to a threshold; and notifying an attendant device of the predicted emotional state of the player in response comparing the predicted emotional state of the player to the threshold.

6. The computer-implemented method of claim 1, wherein the predictive model comprises an artificial neural network model comprising a plurality of input nodes corresponding to a plurality of input parameters, a plurality of hidden nodes coupled to the plurality of input nodes by means of a plurality of connectors, and a plurality of output nodes coupled to the plurality of hidden nodes, each of the plurality of hidden nodes having an associated combinational function and each of the connectors having an associated weight, and some of the plurality of output nodes associated with a discrete emotional state of the player.

7. The computer-implemented method of claim 6, further comprising:

obtaining additional biometric data associated with the player after the occurrence of the game play event;

analyzing the additional biometric data to detect an actual emotional state of the player after the occurrence of the game play event;

comparing the actual emotional state of the player after the occurrence of the game play event with the predicted emotional state of the player as a result of the occurrence of the game play event; and modifying the predictive model based on comparison of the actual emotional state of the player after the occurrence of the game play event with the predicted emotional state of the player as a result of the occurrence of the game play event, wherein modifying the predictive model comprises modifying one of the combinational functions and/or one of the connector weights based on comparison of the actual emotional state of the player after the occurrence of the game play event with the predicted emotional state of the player as a result of the occurrence of the game play event.

8. The computer-implemented method of claim 1, wherein additional input parameters of the predictive model comprise one of: player age; player gender; player nationality; average wager; most recent amount wagered; wagering unit; total coin-in; total amount won; total amount lost; most recent win; most recent loss; duration of gaming session; bonus games played; pay table type; game type; ambient lighting; ambient temperature; ambient noise; and play speed.

9. The computer-implemented method of claim 1, further comprising:

determining an estimated blood alcohol content (BAC) level of the player, wherein the detected-emotion input parameter comprises the BAC level.

10. The computer-implemented method of claim 9, wherein determining the estimated BAC level of the player comprises:

determining an alcoholic drink having an alcohol content served to the player; and determining, based in part on the alcohol content of the alcoholic drink, the estimated BAC level of the player.

11. The computer-implemented method of claim 9, wherein determining the estimated BAC level comprises:

determining a reaction time of the player in real time; and determining, based in part on the reaction time of the first player, the estimated BAC level of the player.

12. A computer-implemented method, comprising:

providing a predictive model of an emotional state of a player of an electronic gaming machine, wherein the predictive model is usable to generate a predicted emotional state of the player based on a game-play input parameter associated with operation of the electronic gaming machine and a detected-emotion input parameter associated with a detected emotional state of the player;

obtaining, via a biometric data input device, biometric data associated with the player while the player is engaged in using the electronic gaming machine;

analyzing the biometric data to detect an emotional state of the player while the player is engaged in using the electronic gaming machine;

generating, via the predictive model, a predicted emotional state of the player as a result of a modification of an aspect of a game play experience of the electronic gaming machine, wherein the aspect of the game play experience is associated with the game-play input parameter of the predictive model and the emotional state of the player is associated with the detected-emotion input parameter of the predictive model;

modifying the aspect of a game play experience of the electronic gaming machine;

obtaining additional biometric data associated with the player after modification of the aspect of the game play experience;

analyzing the additional biometric data to detect an actual emotional state of the player after modification of the aspect of the game play experience;

comparing the actual emotional state of the player after modification of the aspect of the game play experience with the predicted emotional state of the player after modification of the aspect of the game play experience; and modifying the predictive model based on comparison of the actual emotional state of the player after modification of the aspect of the game play experience with the predicted emotional state of the player as a result of modification of the aspect of the game play experience.

13. The computer-implemented method of claim 12, wherein the predictive model comprises an artificial neural network model comprising a plurality of input nodes corresponding to a plurality of input parameters, a plurality of hidden nodes coupled to the plurality of input nodes by means of a plurality of connectors, and a plurality of output nodes coupled to the plurality of hidden nodes, each of the plurality of hidden nodes having an associated combinational function and each of the connectors having an associated weight, and some of the plurality of output nodes associated with a discrete emotional state of the player.

14. The computer-implemented method of claim 13, wherein modifying the predictive model based on comparison of the actual emotional state of the player after modification of the aspect of the game play experience with the predicted emotional state of the player modification of the aspect of the game play experience comprises modifying one of the combinational functions and/or one of the connector weights of the artificial neural network model.

15. The computer-implemented method of claim 12, further comprising:

obtaining feedback from the player describing a subjective emotional state of the player; and modifying the predictive model based on comparison of the subjective emotional state of the player after modification of the aspect of the game play experience with the predicted emotional state of the player after modification of the aspect of the game play experience.

16. An electronic gaming machine, comprising:

a processor; and a biometric input device coupled to the processor and configured to obtain biometric data associated with a player while the player is engaged in using the electronic gaming machine, wherein the processor is configured to perform operations comprising:

providing a predictive model of an emotional state of a player of an electronic gaming machine, machine by the player wherein the predictive model is usable to generate a predicted emotional state of the player based on a game-play input parameter associated with operation of the electronic gaming machine and a detected-emotion input parameter associated with a detected emotional state of the player;

analyzing the biometric data to detect an emotional state of the player while the player is engaged in using the electronic gaming machine;

providing the detected emotional state of the player as the detected-emotion input parameter to the predictive model;

detecting a triggering of an occurrence of a game play event of the electronic device, wherein the game play event is associated with the game-play input parameter of the predictive model;

generating, via the predictive model and prior to execution of the game play event, a predicted emotional state of the player as a result of the occurrence of the game play event; and modifying an aspect of a game play experience of the electronic gaming machine based on the predicted emotional state of the player.

17. The electronic gaming machine of claim 16, wherein the processor is further configured to display the game play event to the player, and to modify the aspect of the game play experience before displaying the game play event to the player.

18. The computer-implemented method of claim 1, wherein modifying the aspect of the game play experience of the electronic gaming machine based on the predicted emotional state of the player comprises precompensating for an anticipated emotional response of the player.

19. The electronic gaming machine of claim 16, wherein modifying the aspect of the game play experience of the electronic gaming machine based on the predicted emotional state of the player comprises precompensating for an anticipated emotional response of the player.

20. The computer-implemented method of claim 12, wherein modifying the predictive model comprises modifying the predictive model to precompensate for an anticipated emotional response of the player.

* * * * *